US010923021B2

(12) United States Patent
Bae et al.

(10) Patent No.: US 10,923,021 B2
(45) Date of Patent: Feb. 16, 2021

(54) METHOD FOR DISPLAYING TIME INFORMATION AND ELECTRONIC DEVICE SUPPORTING THE SAME

(71) Applicants: SAMSUNG ELECTRONICS CO., LTD., Suwon-si (KR); CREPAS TECHNOLOGIES CO., LTD., Seoul (KR)

(72) Inventors: Jong Kon Bae, Seoul (KR); Dong Hwy Kim, Hwaseong-si (KR); Sang Woo Kim, Seoul (KR); Jung Hee Yun, Suwon-si (KR); Yo Han Lee, Seoul (KR); Dong Kyoon Han, Seongnam-si (KR); Yun Pyo Hong, Seoul (KR); Hong Kook Lee, Seoul (KR)

(73) Assignees: Samsung Electronics Co., Ltd., Suwon-si (KR); CREPAS Technologies Co., Ltd., Seoul (KR)

( * ) Notice: Subject to any disclaimer, the term of this patent is extended or adjusted under 35 U.S.C. 154(b) by 0 days.

(21) Appl. No.: 16/876,168

(22) Filed: May 18, 2020

(65) Prior Publication Data

US 2020/0279522 A1 Sep. 3, 2020

Related U.S. Application Data

(63) Continuation of application No. 15/690,831, filed on Aug. 30, 2017.

(30) Foreign Application Priority Data

Aug. 30, 2016 (KR) ..... 10-2016-0111125

(51) Int. Cl.
*G09G 3/20* (2006.01)
*G09G 5/00* (2006.01)
(Continued)

(52) U.S. Cl.
CPC ..... *G09G 3/2096* (2013.01); *G04G 3/04* (2013.01); *G04G 7/00* (2013.01); *G04G 7/026* (2013.01);
(Continued)

(58) Field of Classification Search
CPC . G04G 7/00; G04G 7/026; G04G 3/04; G04R 40/06; G09G 5/006; G09G 5/12;
(Continued)

(56) References Cited

U.S. PATENT DOCUMENTS 9,466,263 B2 10/2016 Bae et al.
2003/0076747 A1 4/2003 Jung
(Continued)

FOREIGN PATENT DOCUMENTS

JP 2007-057275 A 3/2007
JP 2008-175633 7/2008
(Continued)

OTHER PUBLICATIONS

U.S. Appl. No. 15/690,831, filed Aug. 30, 2017; Bae et al.
(Continued)

*Primary Examiner* — Xin Sheng
(74) *Attorney, Agent, or Firm* — Nixon & Vanderhye P.C.

(57) ABSTRACT

An electronic device is provided. The electronic device may include a display, a processor operatively connected with the display and configured to generate external reference time information, a display driver integrated circuit configured to periodically or randomly receive the external reference time information from the processor, wherein the display driver integrated circuit is configured to generate internal time information based on an internal clock, to output a clock image corresponding to the internal time information on the display, and if a time error between the external reference time information and the internal time information occurs
(Continued)

during the outputting of the clock image, to output the internal time information, the time error of which is corrected, on the display.

20 Claims, 9 Drawing Sheets

(51) Int. Cl.

| | |
|---|---|
| ***G04R 40/06*** | (2013.01) |
| ***G04G 3/04*** | (2006.01) |
| ***G04G 7/00*** | (2006.01) |
| ***G09G 5/12*** | (2006.01) |

(52) U.S. Cl.
CPC ..... *G04R 40/06* (2013.01); *G09G 5/003* (2013.01); *G09G 5/006* (2013.01); *G09G 5/12* (2013.01); *G09G 2310/08* (2013.01); *G09G 2340/0435* (2013.01); *G09G 2360/12* (2013.01)

(58) Field of Classification Search
CPC ..... G09G 2310/08; G09G 2340/0435; G09G 2360/12; G09G 3/2096; G09G 5/003
See application file for complete search history.

(56) References Cited

U.S. PATENT DOCUMENTS

| | | | |
|---|---|---|---|
| 2004/0252052 | A1 | 12/2004 | Kitatani |
| 2009/0129208 | A1 | 5/2009 | Weiss |
| 2010/0202436 | A1 | 8/2010 | Albert |
| 2014/0063033 | A1 | 3/2014 | Bae |
| 2014/0368429 | A1 | 12/2014 | Bae |
| 2014/0368479 | A1 | 12/2014 | Bae et al. |
| 2015/0325213 | A1 | 11/2015 | Lee et al. |
| 2017/0011683 | A1 | 1/2017 | Bae et al. |

FOREIGN PATENT DOCUMENTS

| | | | |
|---|---|---|---|
| JP | 2008-175634 | | 7/2008 |
| JP | 2008-286780 | A | 11/2008 |
| JP | 2011-112472 | A | 6/2011 |
| JP | 2006-010487 | A | 1/2016 |
| KR | 10-2015-0127319 | A | 11/2015 |

OTHER PUBLICATIONS

PCT International Search Report and Written Opinion for Application No. PCT/KR2017/009450 dated Dec. 4, 2017.
Extended European Search Report dated Jun. 4, 2019 for EP Application No. 17846977.1.

METHOD FOR DISPLAYING TIME INFORMATION AND ELECTRONIC DEVICE SUPPORTING THE SAME

CROSS-REFERENCE TO RELATED APPLICATION

This application is a Continuation of U.S. application Ser. No. 15/690,831, filed Aug. 30, 2017 (abandoned), which claims priority to Korean Application No. 10-2016-0111125, filed Aug. 30, 2016, the entire contents of each of which are all hereby incorporated herein by reference in their entireties.

TECHNICAL FIELD

The present disclosure relates generally to display time information of an electronic device.

BACKGROUND

A conventional electronic device may include a display and may provide a user with various screens visually through the display. For example, the conventional electronic device may output the time information in the display.

In the case of providing time information in the conventional electronic device, an element to process time information and an element to provide a reference time of an electronic device may be operated in an asynchronous state. For this reason, an issue that the time information is incorrectly displayed may occur.

SUMMARY

Example aspects of the present disclosure address at least the above-mentioned problems and/or disadvantages and provide at least the advantages described below. Accordingly, an example aspect of the present disclosure is to provide a time information displaying method that allows time information to be displayed correctly and naturally without a sense of incompatibility in a display process and an electronic device supporting the same.

In accordance with an example aspect of the present disclosure, an electronic device is provided. The electronic device may include a display, a processor operatively connected with the display and configured to generate external reference time information, a display driver integrated circuit configured to periodically or randomly receive the external reference time information from the processor, wherein the display driver integrated circuit is configured to generate internal time information based on an internal clock, to output a clock image corresponding to the internal time information on the display, and if a time error between the external reference time information and the internal time information occurs during the outputting of the clock image, to output the internal time information, the time error of which is corrected, on the display.

In accordance with another example aspect of the present disclosure, a time displaying method of an electronic device is provided. The method may include receiving, at a display driver integrated circuit, external reference time information from a device element disposed within the electronic device, comparing internal time information generated by an internal clock of the display driver integrated circuit with the external reference time information and compensating for difference between the internal time information and the external reference time information if a time error between the internal time information and the external reference time information occurs.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and attendant advantages of the present disclosure will be more apparent and readily appreciated from the following detailed description, taken in conjunction with the accompanying drawings, in which like reference numerals refer to like elements, and wherein.

Throughout the drawings, it should be noted that like reference numbers are used to depict the same or similar elements, features, and structures.

DETAILED DESCRIPTION

Figure 1:
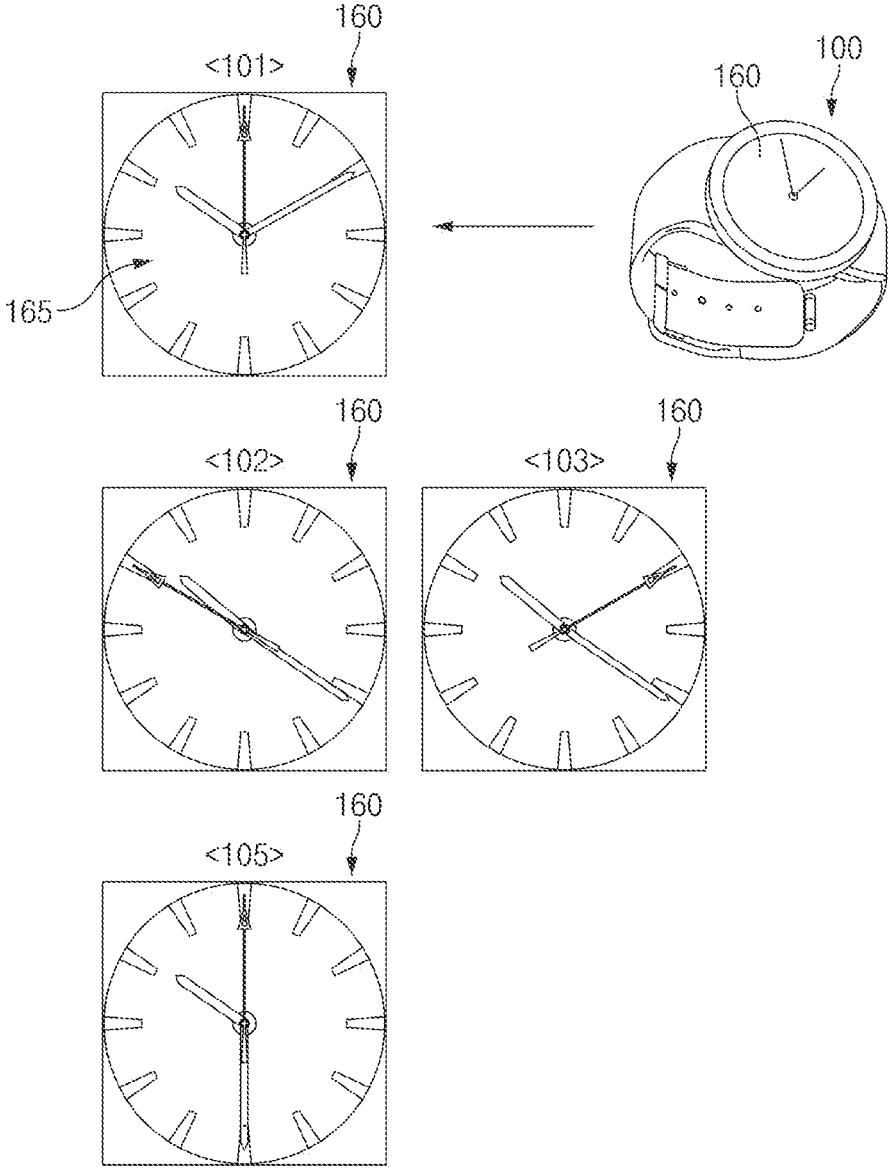
FIG. 1 is a diagram illustrating an example of an electronic device and a screen interface associated with displaying time information, according to an example embodiment of the present disclosure.

Various example embodiments of the present disclosure may be described with reference to accompanying drawings. Accordingly, those of ordinary skill in the art will recognize that modifications, equivalents, and/or alternatives of the various example embodiments described herein can be variously made without departing from the scope and spirit of the present disclosure. With regard to description of drawings, similar elements may be marked by similar reference numerals.

In the disclosure disclosed herein, the expressions "have", "may have", "include" and "comprise", or "may include" and "may comprise" used herein indicate existence of corresponding features (e.g., elements such as numeric values, functions, operations, or components) but do not exclude presence of additional features.

In the disclosure disclosed herein, the expressions "A or B", "at least one of A or/and B", or "one or more of A or/and B", and the like used herein may include any and all combinations of one or more of the associated listed items. For example, the term "A or B", "at least one of A and B", or "at least one of A or B" may refer to all of the case (1) where at least one A is included, the case (2) where at least one B is included, or the case (3) where both of at least one A and at least one B are included.

The terms, such as "first", "second", and the like used herein may refer to various elements of various embodiments, but do not limit the elements. Furthermore, such terms may be used to distinguish one element from another element. For example, "a first user device" and "a second user device" may indicate different user devices regardless of the order or priority thereof. For example, "a first user device" and "a second user device" indicate different user devices.

It will be understood that when an element (e.g., a first element) is referred to as being "(operatively or communicatively) coupled with/to" or "connected to" another element (e.g., a second element), it may be directly coupled with/to or connected to the other element or an intervening element (e.g., a third element) may be present. On the other hand, when an element (e.g., a first element) is referred to as being "directly coupled with/to" or "directly connected to" another element (e.g., a second element), it should be understood that there is no intervening element (e.g., a third element).

According to the situation, the expression "configured to" used herein may be used interchangeably with, for example, the expression "suitable for", "having the capacity to", "designed to", "adapted to", "made to", or "capable of". The term "configured to" does not refer only to "specifically designed to" in hardware. Instead, the expression "a device configured to" may refer to a situation in which the device is "capable of" operating together with another device or other components. CPU, for example, a "processor configured to perform A, B, and C" may refer, for example, to a dedicated processor (e.g., an embedded processor) for performing a corresponding operation or a generic-purpose processor (e.g., a central processing unit (CPU) or an application processor) which may perform corresponding operations by executing one or more software programs which are stored in a memory device.

Terms used in the present disclosure are used to describe specified embodiments and are not intended to limit the scope of the present disclosure. The terms of a singular form may include plural forms unless otherwise specified. Unless otherwise defined herein, all the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal detect unless expressly so defined herein in various embodiments of the present disclosure. In some cases, even if terms are terms which are defined in the disclosure, they may not be interpreted to exclude embodiments of the present disclosure.

An electronic device according to various example embodiments of the present disclosure may include at least one of smartphones, tablet personal computers (PCs), mobile phones, video telephones, e-book readers, desktop PCs, laptop PCs, netbook computers, workstations, servers, personal digital assistants (PDAs), portable multimedia players (PMPs), Motion Picture Experts Group (MPEG-1 or MPEG-2) Audio Layer 3 (MP3) players, mobile medical devices, cameras, wearable devices (e.g., head-mounted-devices (HMDs), such as electronic glasses), an electronic apparel, electronic bracelets, electronic necklaces, electronic appcessories, electronic tattoos, smart watches, or the like, but is not limited thereto.

According to another example embodiment, the electronic devices may be home appliances. The home appliances may include at least one of, for example, televisions (TVs), digital versatile disc (DVD) players, audios, refrigerators, air conditioners, cleaners, ovens, microwave ovens, washing machines, air cleaners, set-top boxes, home automation control panels, security control panels, TV boxes (e.g., Samsung HomeSync™, Apple TV™, or Google TV™), game consoles (e.g., Xbox™ or PlayStation™), electronic dictionaries, electronic keys, camcorders, electronic picture frames, or the like, but are not limited thereto.

According to another example embodiment, the electronic apparatus may include at least one of medical devices (e.g., various portable medical measurement devices (e.g., a blood glucose monitoring device, a heartbeat measuring device, a blood pressure measuring device, a body temperature measuring device, and the like)), a magnetic resonance angiography (MRA), a magnetic resonance imaging (MRI), a computed tomography (CT), scanners, and ultrasonic devices), navigation devices, global positioning system (GPS) receivers, event data recorders (EDRs), flight data recorders (FDRs), vehicle infotainment devices, electronic equipment for vessels (e.g., navigation systems and gyrocompasses), avionics, security devices, head units for vehicles, industrial or home robots, automatic teller's machines (ATMs), points of sales (POSs), or internet of things (e.g., light bulbs, various sensors, electric or gas meters, sprinkler devices, fire alarms, thermostats, street lamps, toasters, exercise equipment, hot water tanks, heaters, boilers, and the like), or the like, but is not limited thereto.

According to another example embodiment, the electronic devices may include at least one of parts of furniture or buildings/structures, electronic boards, electronic signature receiving devices, projectors, or various measuring instruments (e.g., water meters, electricity meters, gas meters, or wave meters, and the like), or the like, but are not limited thereto. In the various embodiments, the electronic device may be one of the above-described various devices or a combination thereof. An electronic device according to an embodiment may be a flexible device. Furthermore, an electronic device according to an embodiment may not be limited to the above-described electronic devices and may include other electronic devices and new electronic devices according to the development of technologies.

Hereinafter, an electronic device according to the various example embodiments may be described with reference to the accompanying drawings. The term "user" used herein may refer to a person who uses an electronic device or may refer to a device (e.g., an artificial intelligence electronic device) that uses an electronic device.

FIG. 1 is a diagram illustrating an example of an electronic device and a screen interface associated with displaying time information, according to an example embodiment of the present disclosure.

Referring to FIG. 1, an electronic device 100 according to an embodiment of the present disclosure may include a display 160 and may output time information depending on operating a specified function. For example, the electronic device 100 may output time information 165 in the display 160 as illustrated in state 101. In state 101, the electronic device 100 may display the time information 165 in an analog type (e.g., time expression with an hour hand, a minute hand, and a second hand) depending on settings. According to various embodiments, the electronic device 100 may display the time information 165 in a digital type (e.g., displaying an hour, a minute, and a second with numbers or texts) depending on settings.

The state 101 may include a state where an application processor of the electronic device 100 is activated to directly control an image display operation of the display 160. In this case, the application processor may transfer control information associated with displaying a screen to a display driver integrated circuit that drives the display 160. The display driver integrated circuit may verify external reference time information of control information that a processor (e.g., an application processor (AP), a communication processor (CP), a sensor hub, or the like) provides and may display the time information 165 based on the external reference time information. Referring to illustration of FIG. 1, the electronic device 100 may display 10:10:00.

In state 102, the electronic device 100 may output a time information screen under control of the application processor and depending on driving of the display driver integrated circuit while the application processor is awakened. In this operation, the display driver integrated circuit of the electronic device 100 may output a time information screen corresponding to, for example, 10:20:50 in the display 160 based on the external reference time information that the application processor provides.

After state 101, the application processor of the electronic device 100 may enter a sleep state. If the display driver integrated circuit and the application processor operate in an asynchronous manner, the display driver integrated circuit may fail to obtain the external reference time information from the application processor when it is in the sleep state, thus outputting internal time information based on an internal clock (or its own clock). Here, an internal clock generating element (or internal time information generating element) of the display driver integrated circuit may generate a clock in which an error (or distribution) occurs with respect to a clock of the application processor due to a mechanical tolerance with a clock generating element of the application processor, a difference between physical characteristics according to a temperature or a voltage, or the like. To address this issue, after a specific time elapses in state 101, a reference time by the application processor is 10:20:50 as in state 102. On the other hand, due to influence of a temperature or a voltage, internal time information may be displayed with 10:20:10 as illustrated in state 103 in the display 160 based on an internal clock generated in the display driver integrated circuit.

In a state where time information different from the external reference time information is displayed as in state 103, the display driver integrated circuit of the electronic device 100 may change current time information if the external reference time information is obtained and may display the time information changed to correspond to the external reference time information as in state 105. In this operation, the electronic device 100 may gradually change a specific time (e.g., 20 seconds) corresponding to a time difference. For example, the electronic device 100 may vary a display state of time information gradually and/or rapidly to coincide with the external reference time information. Alternatively, in the case where a screen according to execution of an always on display (AOD) function is turned off and is then turned on or in the case where the execution screen of the AOD function is changed (e.g., an analog clock screen is changed to a digital clock screen), the electronic device 100 may correct an error of the time information gradually or at a specified time (e.g., occurrence of an event). For example, the electronic device 100 may correct an error of the time information at a time in the following manner: in the case where a current time is 00:10:10 and an error of 2 seconds occurs, the current time is changed to 00:10:13 when 1 second elapses from 00:10:10. For another example, the electronic device 100 may correct an error of the time information gradually in the following manner: in the case where a current time is 00:10:10 and an error of 2 seconds occurs, the current time is changed to 00:10:12 when 1 second elapses from 00:10:10 and is changed to 00:10:14 when 1 second elapses from 00:10:12.

As described above, in a process where the display driver integrated circuit displays internal time information based on an internal clock, the electronic device 100 according to an embodiment of the present disclosure may correct a time at a regular period based on the external reference time information that the application processor provides or depending on occurrence of an event (e.g., a point in time when the application processor provides image data), thus displaying a time correctly.

The above-described electronic device 100 may provide the AOD function of outputting part of the time information on the display 160. For example, the AOD function may be applied to various modes such as a sleep mode, an inactive mode, or the like. Also, the above-described screen interface is illustrated as being rectangular in shape. However, the shape of the above-described screen interface may be changed to a circular shape or any other shapes depending on a shape of a display. The electronic device 100 may include a smartphone of a rectangular shape, a smartphone of an edge type, and a wearable electronic device such as a pad, a clock device, or the like, but is not limited thereto.

Figure 2:
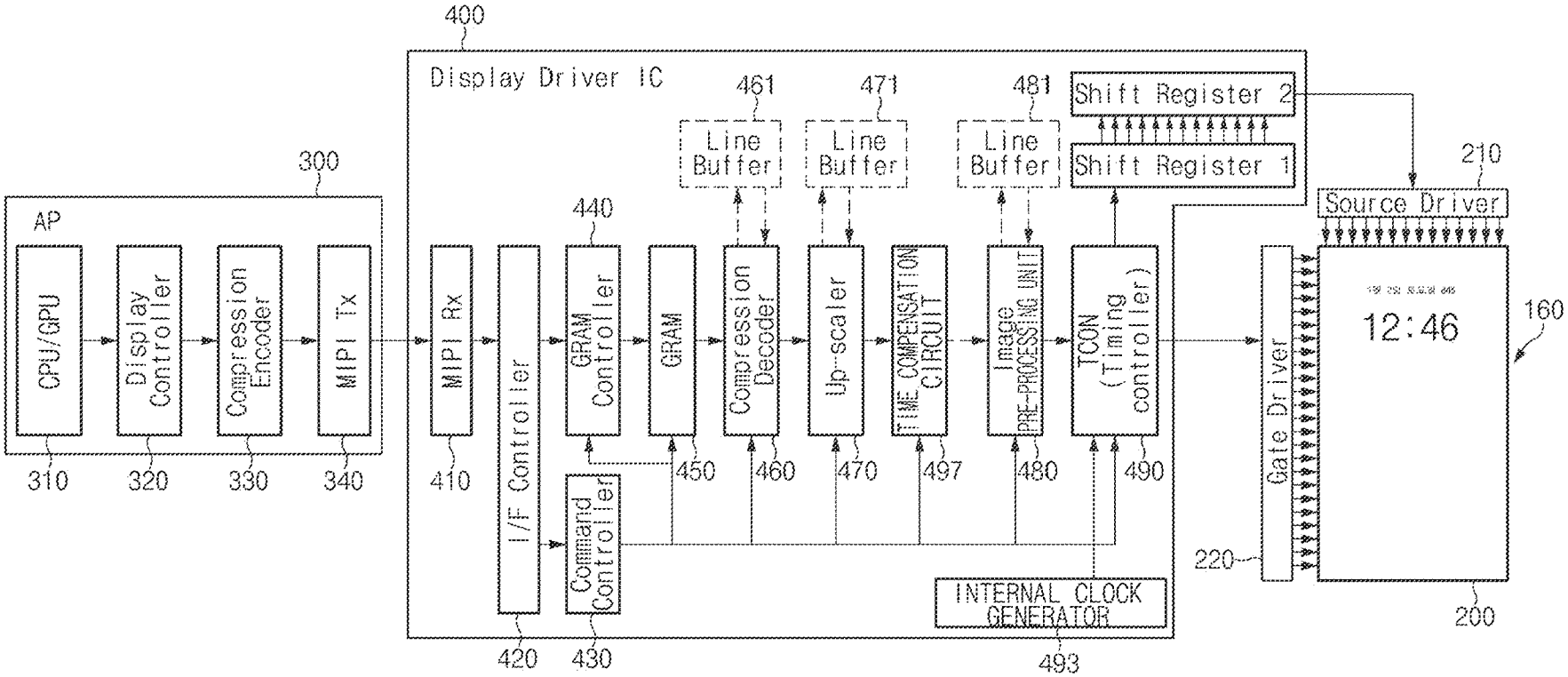
FIG. 2 is a block diagram illustrating an example of part of a configuration of the electronic device which is associated with driving a display according to an example embodiment of the present disclosure.

FIG. 2 is a block diagram illustrating an example of a part of a configuration of an electronic device which is associated with driving a display, according to an example embodiment of the present disclosure.

Referring to FIG. 2, a configuration associated with driving a display of the present disclosure may include a processor (e.g., including processing circuitry) 300 (e.g., an application processor, a communication processor, a sensor hub, or the like), a display driver integrated circuit (DDI) 400, and the display 160.

The processor 300 may include various processing circuitry and generate image data according to various embodiments and may provide the generated image data to the display driver integrated circuit 400. For example, the processor 300 may encode or compress image data in a specified manner and may provide the encoded or compressed image data to the display driver integrated circuit 400. The above-described processor 300 may include various processing circuitry, such as, for example, and without limitation, at least one of the application processor, the communication processor (CP), and the sensor hub. The processor 300 may transfer a command including external reference time information (e.g., a command including real time clock (RTC) information) to the display driver integrated circuit 400.

The above-described processor 300 may include various processing circuitry, such as, for example, and without limitation, a central processing unit (CPU)/graphics processing unit (GPU) 310, a display controller 320, a compression module 330 (e.g., a compression encoder), an internal transmit interface 340 (e.g., MIPI Tx).

The CPU/GPU 310 may include various processing circuitry and process data to be output on the display 160 in response to scheduled information or a user input. The CPU/GPU 310 may transfer the processed data to the display controller 320.

The display controller 320 may generate data to be transferred to the display driver integrated circuit 400 based on data that the CPU/GPU 310 transfers. For example, the display driver integrated circuit 320 may transfer a command including external reference time information to the display driver integrated circuit 400.

The compression module 330 may include various circuitry and encode image data generated in the display controller 320 in a specified manner (e.g., a display stream compression (DSC) manner defined in VESA). Accordingly, the image data generated in the display controller 320 may be compressed (a decrease in the amount of image data). For example, the magnitude (or amount) of image data generated in the display controller 320 may decrease to 1/n by the encoding of the compression module 330. According to various embodiments, the compression module 330 may be omitted. That is, image data may be transferred to the display driver integrated circuit 400 without a compression process.

The internal transmit interface 340 may include various circuitry to transfer the image data encoded by the compression module 330 and control information (e.g., a command including the external reference time information) to the display driver integrated circuit 400. The internal transmit interface 340 may include, for example, a mobile industry processor interface (MIPI).

The display driver integrated circuit 400 may output image data corresponding to time information to a display panel 200 under control of the processor 300. The image data corresponding to the time information may be stored and processed in a memory 450 included in the display driver integrated circuit 400. The display driver integrated circuit 400 may compare internal time information generated by an internal clock with the external reference time information that the processor 300 transfers. When an error is identified in the comparison process, the display driver integrated circuit 400 may immediately correct the error; alternatively, the display driver integrated circuit 400 may divide the error to be corrected into error values of a small magnitude (dividing the error into errors in units of one second in the case where a difference of 10 seconds occurs) and may correct the error values of the small magnitude in units of a specific time.

In this regard, the display driver integrated circuit 400 may receive the external reference time information (e.g., RTC information) received from the processor 300 upon initially driving the display 160. The display driver integrated circuit 400 may generate internal time information by an internal clock to be output on the display 160 upon initially driving the display 160. As described above, depending on a driving condition (e.g., a variation in a temperature or a voltage) of the display 160, a display time may fluctuate or a distribution may occur in a clock frequency of an oscillator (OSC). The display driver integrated circuit 400 may compare the external reference time information (command) periodically or randomly input from the processor 300 with the internal time information generated by the internal clock; if a difference is generated, the display driver integrated circuit 400 may compensate for the difference. For example, when an error occurs, the display driver integrated circuit 400 may correct the number of frame synchronization (or sync) signals or may correct the number of line sync signals. Alternatively, the display driver integrated circuit 400 may correct a clock frequency of the oscillator (or an internal clock generator).

The above-described display driver integrated circuit 400 may include an internal receive interface 410 (e.g., MIPI Rx), an interface controller 420, a command controller 430, a memory controller 440, the memory 450 (e.g., a graphics RAM (GRAM)), a decompression module 460 (e.g., a compression decoder), an up-scaler 470, a time compensation circuit 497, an image pre-processing unit 480, a display timing controller 490, and an internal clock generator 493 (e.g., an oscillator). According to various embodiments, the display driver integrated circuit 400 may further include a module to adjust the number of frames (or a frame frequency), a module to apply pixel power, or the like. In addition, the display driver integrated circuit 400 may further include a line buffer 461 associated with operating the decompression module 460, a line buffer 471 associated with operating the up-scaler 470, and a line buffer 481 associated with operating the image pre-processing unit 480. In addition, the display driver integrated circuit 400 may further include at least one shift register that receives data from the display timing controller 490. Also, the display driver integrated circuit 400 may further include a source driver 210 and a gate driver 220, which are associated with driving the display 160, depending on a design change.

The internal receive interface 410 may communicate with the processor 300 to receive control information (e.g., control information including the external reference time information) and image data from the processor 300. The internal receive interface 410 may include, for example, and without limitation, an MIPI receiver circuit. If the internal receive interface 410 receives control information and image data through the MIPI transmit circuit of the processor 300, the internal receive interface 410 may transfer the control information and the image data to the interface controller 420. According to various embodiments, the internal receive interface 410 may receive only the external reference time information from the processor 300 at a regular period or in response to occurrence of an event.

The interface controller 420 may receive image data and/or control information from the processor 300. The interface controller 420 may transfer the received image data to the memory controller 440. The interface controller 420 may transfer the received control information to the command controller 430. For example, the interface controller 420 may transfer the external reference time information to the command controller 430.

The memory controller 440 may write the image data received from the interface controller 420 in the memory 450. For example, the memory controller 440 may write image data from the processor 300 in the memory 450 depending on a frame rate of the image data.

The memory 450 may include a graphics RAM. The memory 450 may store data that the memory controller 440 transfers. In this operation, the memory 450 may store image data at a specified frame rate (e.g., 60 Hz) under control of the processor 300. The stored image data may include data that are compressed by the processor 300 or are not compressed. The memory 450 may include a memory space corresponding to a resolution and/or the number of color gradations of the display panel 200. The memory 450 may include a frame buffer or a line buffer. The number of times that the memory 450 is updated or an update speed of the memory 450 may vary with a type of an image to be output on the display panel 200. For example, when a video is played, the memory 450 may store image data corresponding to a frame of the video at a specified speed under control of the processor 300 or under control of the display driver integrated circuit 400. In the case of a still image, the memory 450 may store a previous still image until an image is updated. According to various embodiments, the memory 450 may store image data associated with displaying time information. In a sleep state of the processor 300, the image data associated with displaying the time information may be accessed by the display driver integrated circuit 400 automatically so as to be output on the display 160 (e.g., a memory access is performed under control of the display driver integrated circuit 400 regardless of control of the processor 300). The image data associated with displaying the time information may correspond to, for example, at least one of various image types such as an analog type or a digital type. In addition, the memory 450 may further include a side memory (or auxiliary memory) that is operated in connection with compensating for an error of time information.

The command controller 430 may control the display timing controller 490 such that image data stored in the memory 450 are output to a specified area of the display panel 200 at a specified frame rate. The command controller 430 may be referred to as "control logic". The command controller 430 may provide the external reference time information to the time compensation circuit 497.

In the case where at least part of image data read from the memory 450 is determined as being encoded, the decompression module (e.g., compression decoder) 460 may decode the encoded at least partial image data in a specified manner and may transfer the decoded data to the display timing controller 490. For example, if the magnitude of image data is compressed to 1/n by the compression module 330 of the processor 300, the decompression module 460 may decompress the compressed image data to image data before compression.

The up-scaler 470 and/or the image pre-processing unit 480 may be disposed between the decompression module 460 and the display timing controller 490. According to various embodiments, in the case where at least partial image data selected by the command controller 430 are not encoded, a configuration of the decompression module 460 may not be omitted or may be bypassed.

The up-scaler 470 may enlarge the decompressed image at a specified magnification. According to an embodiment, the up-scaler 470 may enlarge image data to be output on the display panel 200 in the case where there is a need to enlarge the image data depending on the magnitude of the image data or user settings. The up-scaler 470 may transfer the image data enlarged by the up-scaler 470 to the display timing controller 490. In the case where there is no need to enlarge at least part of the image data, a configuration of the up-scaler 470 may not be omitted or may be bypassed.

The time compensation circuit 497 may receive a command periodically or randomly transferred to the display driver integrated circuit 400 from a device element that is able to provide the external reference time information (e.g., RTC clock information). Here, the command may include the external reference time information, and the device element may include the processor 300 (e.g., AP or CP) placed outside the display driver integrated circuit 400. The time compensation circuit 497 may initialize or update an internal time information value, which is calculated by an internal clock based on the received external reference time information and is to be output on the display 160.

According to an embodiment, if the time compensation circuit 497 receives the command including the external reference time information from the processor 300, the time compensation circuit 497 may identify and/or verify a difference between the external reference time information (e.g., a time value of a host (AP/CP/sensor hub) side) and internal time information generated based on the internal clock of the display driver integrated circuit 400. When the time difference occurs, to compensate for (e.g., adjust) the time difference, the time compensation circuit 497 may compensate for the time difference, e.g., an error by adjusting a counter that generates a time reference synchronization signal of the display driver integrated circuit (400) side. Alternatively, the time compensation circuit 497 may gradually correct display data associated with a time by gradually adjusting an error between the external reference time information (e.g., reference time information that the processor 300 provides) and internal time information due to an asynchronous operation between the processor 300 and the display driver integrated circuit 400 based on a period of a time synchronization signal in the display driver integrated circuit 400.

According to various embodiments, the time compensation circuit 497 may compensate for a time error in correspondence to a specified temperature variation. For example, the time compensation circuit 497 may maintain an inactive state when a current temperature is within a specified temperature range. In the case wherein the current temperature is out of the specified temperature range, the time compensation circuit 497 may be activated to compensate for an error. The temperature information may be provided by the processor 300, and the time the compensation circuit 497 may be activated or deactivated according to a command that the processor 300 provides.

According to an embodiment, in the case where the internal time information of the display driver integrated circuit 400 is later than the external reference time information, the time compensation circuit 497 may perform a compensation operation until the internal time information and the external reference time information coincide with each other, by making a period of time synchronization (e.g., Vsync or Hsync) in the display driver integrated circuit 400 or a display time value fast during a specific time. In the case where the internal time information of the display driver integrated circuit 400 is faster than the external reference time information, the time compensation circuit 497 may compensate for a time by making a period of time synchronization in the display driver integrated circuit 400 or a display time value late during a specific time.

With regard to a period variation in the time synchronization, the time compensation circuit 497 may correct the number of frame sync signals. For example, the time compensation circuit 497 may compensate for a time variation by correcting the number of Vsync by which a specified time unit (e.g., one second) is defined. According to an embodiment, in the case where settings are made to output 60 frames in the specified time unit (e.g., 1 second, 1.5 seconds, 2 seconds, or the like) (60 Hz, 45 Hz, 30 Hz, or the like; below, 60 Hz is mainly exemplified), the time compensation circuit 497 may compensate for a time by decreasing or increasing the number of 60-frame sync calculated in units of 1 second (e.g., applying a 59-frame sync in units of 1 second or applying a 61-frame sync in units of 1 second). Alternatively, in the case where settings are made to output 30 frames within 1 second, the time compensation circuit 497 may compensate for a time variation by adjusting the number of 30-frame sync calculated in units of 1 second (e.g., applying a 29-frame sync in units of a specified time unit (e.g., 1 second) or applying a 31-frame sync in units of a specified time unit (e.g., 1 second)).

According to various embodiments, the time compensation circuit 497 may correct the number of line sync signals. For example, the time compensation circuit 497 may correct the number of Hsync by which a frame is defined. Alternatively, the time compensation circuit 497 may correct a clock frequency of an oscillator (or an internal clock generator) generating the internal clock by directly correcting an RC offset of the oscillator. When the internal time information is output, the time compensation circuit 497 may divide the total error by a specific value to gradually correct a time within an error range. With the above description, the time compensation circuit 497 may correct an error while the user fails to perceive correction of the error. Alternatively, the time compensation circuit 497 may uniformly maintain a speed of the internal clock through adjusting an offset of the oscillator. For example the time compensation circuit 497 may correct the error by adjusting an update speed of an internal time information generator, with regard to correction of the time information error.

The image pre-processing unit 480 may improve the image quality of image data. The image pre-processing unit 480 may include, for example, a pixel data processing circuit, a pre-processing circuit, a gating circuit, and the like.

The display timing controller (TCON) 490 may control timing of elements included in the display driver integrated circuit 400. For example, the display timing controller 490 may adjust timing when image data received from the processor 300 are stored in the memory 450 and timing when image data stored in the memory 450 are read, so as not to be overlapped. The display timing controller 490 may control timing when image data stored in the memory 450 are transferred to the decompression module 460 and the up-scaler 470 after being read at a specified frame rate under control of the command controller 430.

The display timing controller 490 may transfer image data received from the image pre-processing unit 480 to the source driver 210 under control of the command controller 430 and may control an output of a gate signal of the gate driver 220. According to an embodiment, the display timing controller 490 may be implemented in the command controller 430. The display timing controller 490 may convert image data received from the memory 450 through the decompression module 460, the up-scaler 470, and/or the image pre-processing unit 480 into an image signal and may supply the image signal to the source driver 210 and the gate driver 220 of the display panel 200. The display timing controller 490 may control displaying of time information based on Vsync or Hsync, the number of which is changed according to time correction of the time compensation circuit 497.

The display 160 may include the source driver 210, the gate driver 220, and the display panel 200. In addition, the display 160 may further include a touch panel, a touch IC, a pressure sensor, a pressure sensor IC, a digitizer, and the like, which may be associated with a user input. The source driver 210 and the gate driver 220 may be implemented to belong to the display 160 or to the display driver integrated circuit 400 as described above, depending on a change in an implementation manner or a product implementation manner.

The display panel 200 may display various information (e.g., multimedia data, text data, or the like) to a user. The display panel 200 may include, for example, a liquid-crystal display (LCD) panel, an active-matrix organic light-emitting diode (AM-OLED) panel, or the like, but is not limited thereto. For example, the display panel 200 may be implemented to be flexible, transparent, or wearable. Also, the display panel 200 may be included in, for example, a cover of a case electrically coupled to the electronic device 100.

The display panel 200 may be supplied with an image signal corresponding to image data from the display driver integrated circuit 400 to display a screen associated with the image data. In the display panel 200, a plurality of data lines and a plurality of gate lines may cross each other, and a plurality of pixels may be disposed at intersections of the data lines and the gate lines. In the case where the display panel 200 corresponds to an OLED panel, each of the plurality of pixels may include at least one or more switching elements (e.g., FET) and one OLED. Each pixel may produce light based on an image signal received from the display driver integrated circuit 400 at specified timing. The display panel 200 may have, for example, a resolution of wide quad high definition (WQHD) (2560×1440).

The source driver 210 and the gate driver 220 may generate signals to be supplied to a scan line and a data line (not illustrated) of the display panel 200, based on a source control signal and a gate control signal received from the display timing controller 490, respectively.

As described above, the electronic device 100 according to an embodiment of the present disclosure may correct internal time information by an internal clock of the display driver integrated circuit 400 based on the external reference time information (e.g., external reference time information of the processor 300). Accordingly, the electronic device 100 may correct a time naturally while displaying a time exactly.

Figure 3:
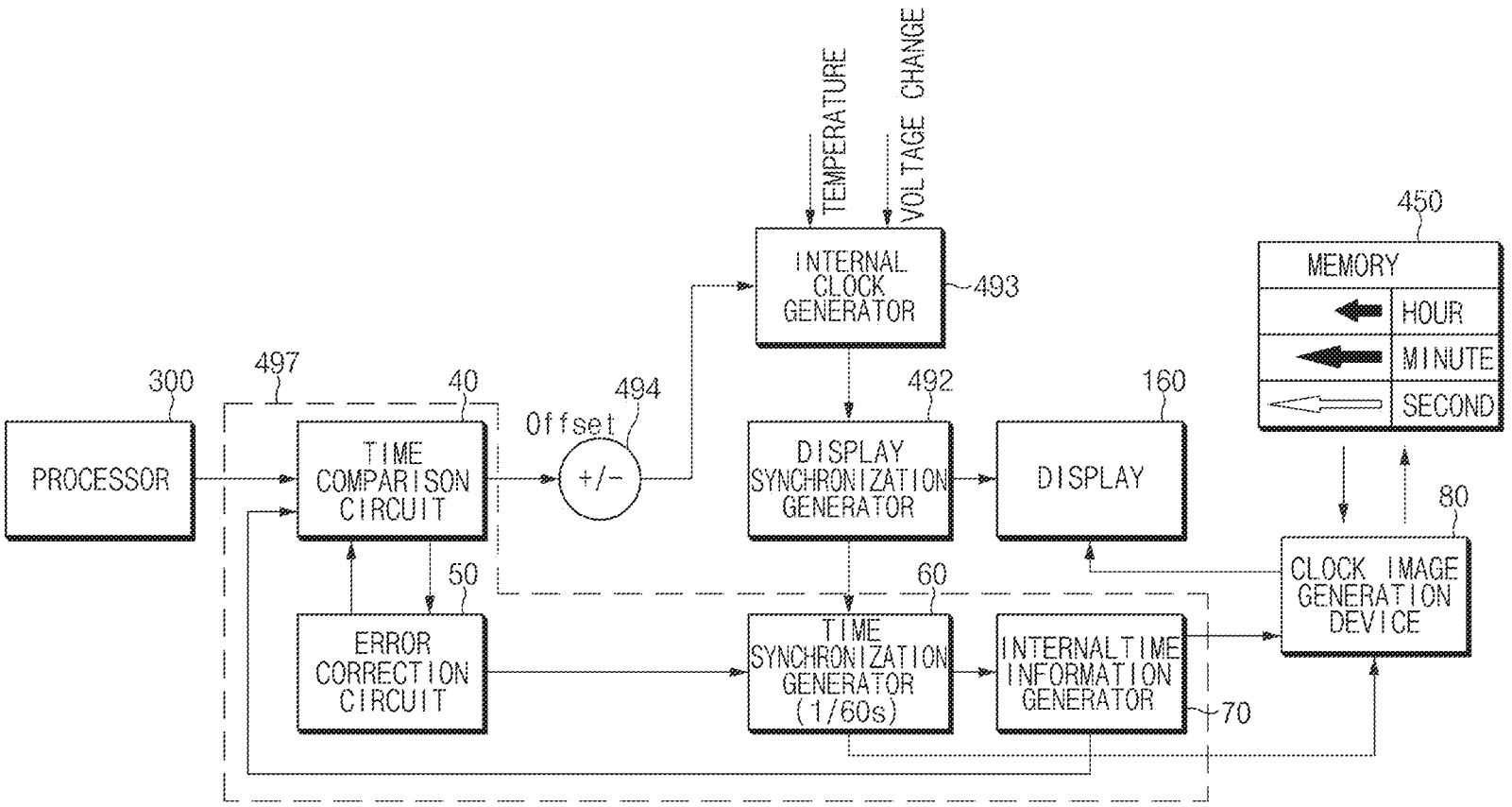
FIG. 3 is a block diagram illustrating an example of the electronic device including an error correction circuit according to an example embodiment of the present disclosure.

FIG. 3 is a block diagram illustrating a part of a configuration of an electronic device including a time compensation circuit and a clock image creation device, according to an example embodiment of the present disclosure.

Referring to FIG. 3, the electronic device 100 may include the processor 300, the display driver integrated circuit 400, and the display 160.

The display driver integrated circuit 400 may include elements comprising the time compensation circuit 497 described in FIG. 2, the internal clock generator 493, a display synchronization generator 492, an offset processing unit 494, and a clock image generation device 80. The time compensation circuit 497 may include a time comparison circuit 40, an error correction circuit 50, a time synchronization generator 60, and an internal time information generator 70.

The internal clock generator 493 may include various circuitry to generate a clock of a specified frequency by using an oscillator and may transfer the generated clock to the display synchronization generator 492. The display synchronization generator 492 may include various circuitry to generate a display synchronization signal for outputting display data and may supply the generated display synchronization to the display 160 (e.g., the display 160 through the display timing controller 490). The display synchronization generator 492 may provide the display synchronization signal to the time synchronization generator 60. The time synchronization generator 60 may generate a time synchronization signal based on the display synchronization signal provided from the display synchronization generator 492 and may transfer the generated time synchronization to the internal time information generator 70. Here, the time synchronization generator 60 may include circuitry to correct a time synchronization value based on correction data that the error correction circuit 50 provides and may transfer the generated time synchronization value to the internal time information generator 70.

The time comparison circuit 40 may include circuitry to compare the external reference time information and the internal time information of the display driver integrated circuit 400. The time comparison circuit 40 may calculate (determine) a time error between the external reference time information and the internal time information. The time comparison circuit 40 may calculate an offset value of an oscillator to be corrected from the calculated time error and may transfer offset information of an internal clock corresponding to the calculated time error to the offset processing unit 494 such that a speed of the oscillator (e.g., the internal clock generator 493) is corrected. Here, the time comparison circuit 40 may control the display 160 to exactly maintain a display frequency (display sync) of 1/60 s upon driving a display at 60 Hz.

The error correction circuit 50 may receive a correction value from the time comparison circuit 40 to calculate a value (e.g., a time sync speed, a time necessary for correction (the number of sync)) necessary for correction. For example, when an error of +1 second occurs, the error correction circuit 50 may generate information that allows 1/59s (sec) to be generated for 60 seconds with respect to a time sync signal (e.g., Vsync) and may transfer the information to the time synchronization generator 60. After an error is completely corrected, the error correction circuit 50 may provide the time synchronization generator 60 with information that allows a time sync signal to be generated at 1/60s like a normal display sync signal.

If the time synchronization generator 60 receives calculated information from the error correction circuit 50, the time synchronization generator 60 may generate a time sync value to correspond to the received correction data. For example, when (+) error occurs, the time synchronization generator 60 may generate the display sync at 1/60s and may generate the time sync at 1/59s. For example, when (−) error occurs, the time synchronization generator 60 may generate the display sync at 1/60s and may generate the time sync at 1/61s.

The internal time information generator 70 may generate internal time information based on the external reference time that the processor 300 transfers. According to an embodiment, when the display 160 is initially driven, the internal time information generator 70 may generate initial internal time information based on the external reference time information that the processor 300 transfers and may generate internal time information updated according to an increase in a count. According to an embodiment, the internal time information generator 70 may transfer display data to the display 160 such that the display 160 calculates and displays time information using the time sync value. For example, the internal time information generator 70 may display a time depending on a time synchronization signal.

The clock image generation device 80 may include circuitry to generate a clock image corresponding to a current time based on a clock image stored in the memory 450 and time information that the internal time information generator 70 transfers. The clock image stored in the memory 450 may include, for example, hand images corresponding to an hour, a minute, and a second, respectively. Alternatively, the clock image may include digital number images corresponding to an hour, a minute, and a second, respectively. The clock image generation device 80 may generate an image in which a location of a hand indicating an hour, a location of a hand indicating a minute, and a location of a hand indicating a second are adjusted and may transfer the image to the display 160. According to various embodiments, the clock image may be stored and operated in a separate auxiliary memory. The clock image may be information that is received and stored from the processor 300 while the processor 300 is in an active state (or a wake-up state). The clock image may be changed according to a user manipulation. For example, if the user requests a change in an AOD clock image, the processor 300 may transfer a changed clock image to the display driver integrated circuit 400, and the display driver integrated circuit 400 may store the changed clock image in the memory 450 or an auxiliary memory.

As described above, the display driver integrated circuit 400 according to an embodiment of the present disclosure may correct a display clock and a frequency of an oscillator clock without a reference clock, which is provided from the processor 300, such as a mobile industry processor interface (MIPI) clock, an external clock, or the like. The display driver integrated circuit 400 may implement a frequency of a display frame exactly to a specified frequency (e.g., 60 Hz or a specific frequency) in terms of an image quality and performance of display. Also, the display driver integrated circuit 400 may drive a self clock upon performing an AOD function. In addition, as a display driving frequency (e.g., 60 Hz) is exactly implemented, even though a stylus pen function is supported, the electronic device 100 may suppress interference between a frequency according to the use of the stylus pen and a frequency according to an information display operation of the display 160. Since the above-described electronic device 100 displays internal time information by using an internal clock of the display driver integrated circuit 400, the electronic device 100 may reduce power that is unnecessarily consumed when the display 160 uses the external reference time information (an external crystal, a PMIC clock, an MIPI clock, or the like).

According to various embodiments, the electronic device may include a display, a processor operatively connected with the display and configured to generate external reference time information, a display driver integrated circuit configured to periodically or randomly receive the external reference time information from the processor, wherein the display driver integrated circuit is configured to generate internal time information based on an internal clock, to output a clock image corresponding to the internal time information on the display, and if a time error between the external reference time information and the internal time information occurs during the outputting of the clock image, to output the internal time information, the time error of which is corrected, on the display.

According to various example embodiments, the display driver integrated circuit may be configured to compensate (adjust) for the time error by correcting the number of frame sync signals associated with an output of display data.

According to various example embodiments, the display driver integrated circuit may be configured to compensate for a fast time error by increasing the number of frame sync signals processed in units of a specified time if the internal time information is faster than the external reference time information.

According to various example embodiments, the display driver integrated circuit may be configured to in the case where an image is output at a frame period of "X" Hz (X being a natural number), divide a magnitude of the fast time error by "1/X" seconds and process frame sync signals, which are obtained by adding a frame synchronization signal corresponding to "1/X" to frame sync signals for each vertical synchronization or frame sync signals for each line synchronization, in units of a specified time (e.g., 1 second).

According to various example embodiments, the display driver integrated circuit may be configured to compensate for a late time error by decreasing the number of frame sync signals processed in units of a specified time (e.g., 1 second) if the internal time information is later than the external time reference information.

According to various example embodiments, the display driver integrated circuit may be configured to in the case where an image is output at a frame period of "X" Hz (X being a natural number), divide a magnitude of the late time error by "1/X" seconds and process frame sync signals, which are obtained by subtracting a frame synchronization signal corresponding to "1/X" from frame sync signals for each vertical synchronization or frame sync signals for each line synchronization, in units of a specified time (e.g., 1 second).

According to various example embodiments, the display driver integrated circuit may be configured to generate the internal time information corresponding to the external reference time information received upon initially driving the display, to generate the internal time information based on the internal clock when the processor is in a sleep state, to output the internal time information on the display, and to compensate for the time error or generate the internal time information and compensate for the time error, while an always on display (AOD) function of the electronic device is executed.

According to various example embodiments, the display driver integrated circuit may further include a memory configured to store display data associated with displaying time information, a time compensation circuit configured to verify the time error between the external reference time information and the internal time information and to generate the time information, the time error of which is corrected, a display timing controller configured to control the display such that the time error-corrected time information is output, an internal clock generator configured to generate the internal clock, a display synchronization generator configured to generate a display synchronization signal based on the internal clock and to provide the display synchronization signal on the display, and a clock image generation device configured to generate the clock image.

According to various example embodiments, the display driver integrated circuit may be configured to correct an offset of the internal clock generator generating the internal clock by a degree corresponding to the time error.

According to various example embodiments, the time compensation circuit may include a time comparison circuit configured to compare the external reference time information and the internal time information generated by the internal clock, an error correction circuit configured to generate an error correction signal corresponding to a value of the time error, a time synchronization generator comprising circuitry configured to generate a time synchronization signal based on the error correction signal received from the error correction circuit and the display synchronization signal that the display synchronization generator provides and an internal time information generator comprising circuitry configured to generate the time information based on the time synchronization signal.

Figure 4:
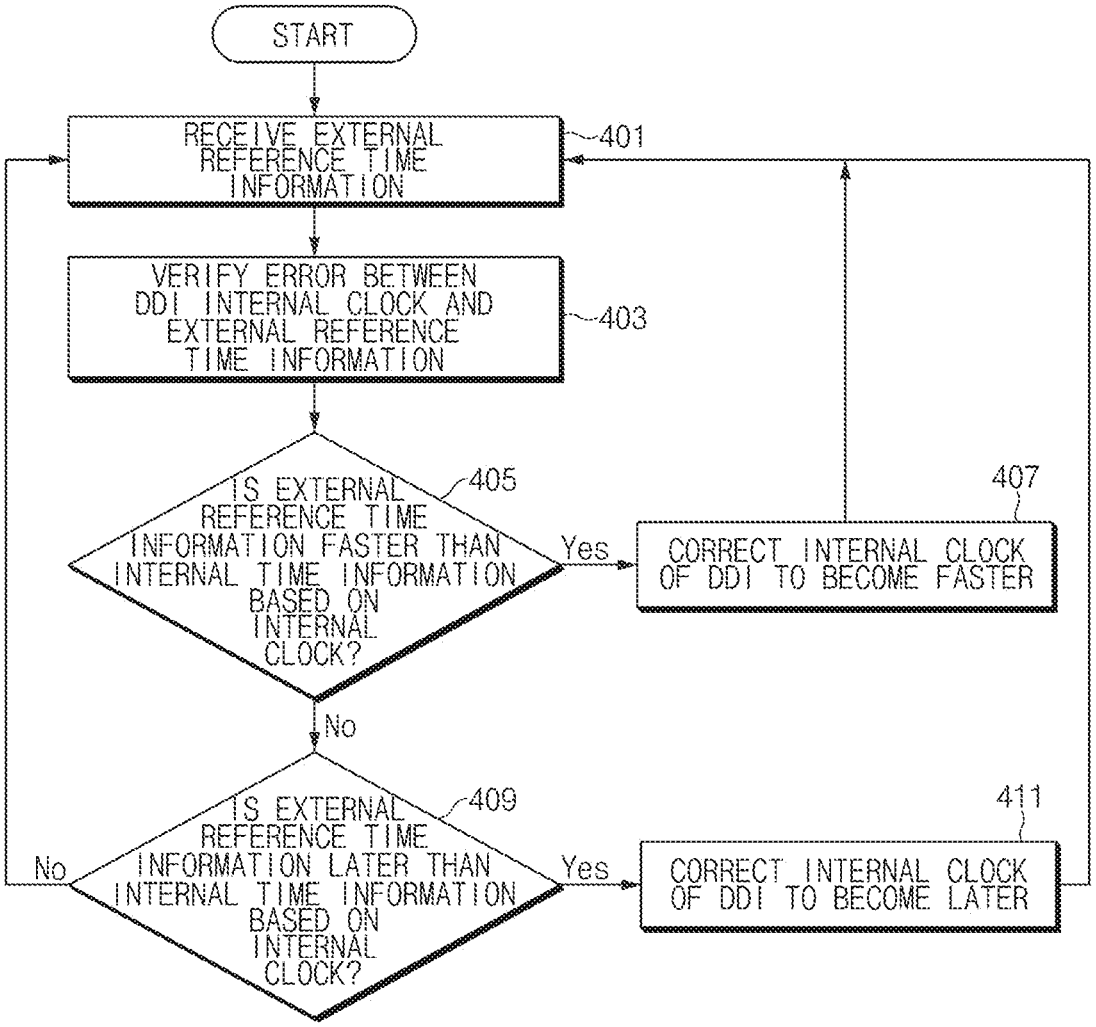
FIG. 4 is a flowchart illustrating an example method of driving a display associated with displaying a time, according to an example embodiment of the present disclosure.

FIG. 4 is a flowchart illustrating an example display driving method associated with displaying a time, according to an example embodiment of the present disclosure.

Referring to FIG. 4, with regard to a display driving method according to an embodiment of the present disclosure, in operation 401, the display driver integrated circuit 400 may receive external reference time information from the processor 300. Here, the processor 300 may include a device element, which has an RTC clock, such as an application processor, a communication processor, a sensor hub, or the like.

In operation 403, the display driver integrated circuit 400 may verify (identify or determine) an error between the received external reference time information and internal time information that is based on a self clock (or internal clock) in the display driver integrated circuit 400. In this regard, the display driver integrated circuit 400 may obtain an internal clock from the internal clock generator 493 and may use the time comparison circuit 40 to compare internal time information generated based on the internal clock and the external reference time information that the processor 300 provides.

In operation 405, the display driver integrated circuit 400 may verify (determine) whether the external reference time information is faster than internal time information based on the internal clock. When the display 160 is initially driven, the display driver integrated circuit 400 may continue to generate the internal clock while receiving the external reference time information from the processor 300, thus displaying the same time information as the external reference time information in the display 160 at a point in time when a time is displayed. Afterwards, the display driver integrated circuit 400 may continue to count the internal clock to generate and display time information to be output on the display 160. If the external reference time information is received after the time information is displayed, the display driver integrated circuit 400 may verify whether the external reference time information is faster than the internal time information according to the internal clock, while comparing the internal time information with the external reference time information. If the external reference time information is faster than the internal time information according to the internal clock, in operation 407, the display driver integrated circuit 400 may correct the internal time information according to the internal clock of the display driver integrated circuit 400 so as to become faster. For example, the display driver integrated circuit 400 may adjust a counter of Vsync (a vertical synchronization signal of a display) included in sync associated with driving a display such that the internal time information according to the internal clock is corrected to become faster.

If the external reference time information is not faster than the internal time information according to the internal clock, in operation 409, the display driver integrated circuit 400 may verify whether the external reference time information is later (slower) than the internal time information based on the internal clock. If the external reference time information is the same as the internal time information according to the internal clock, the display driver integrated circuit 400 may return to operation 401 to again perform the following operations. If the external reference time information is later (slower) than the internal time information based on the internal clock, in operation 411, the display driver integrated circuit 400 may correct the internal time information based on the internal clock of the display driver integrated circuit 400 so as to become slower. For example, the display driver integrated circuit 400 may adjust the Vsync counter to allow the internal time information according to the internal clock to be late.

Figure 5:
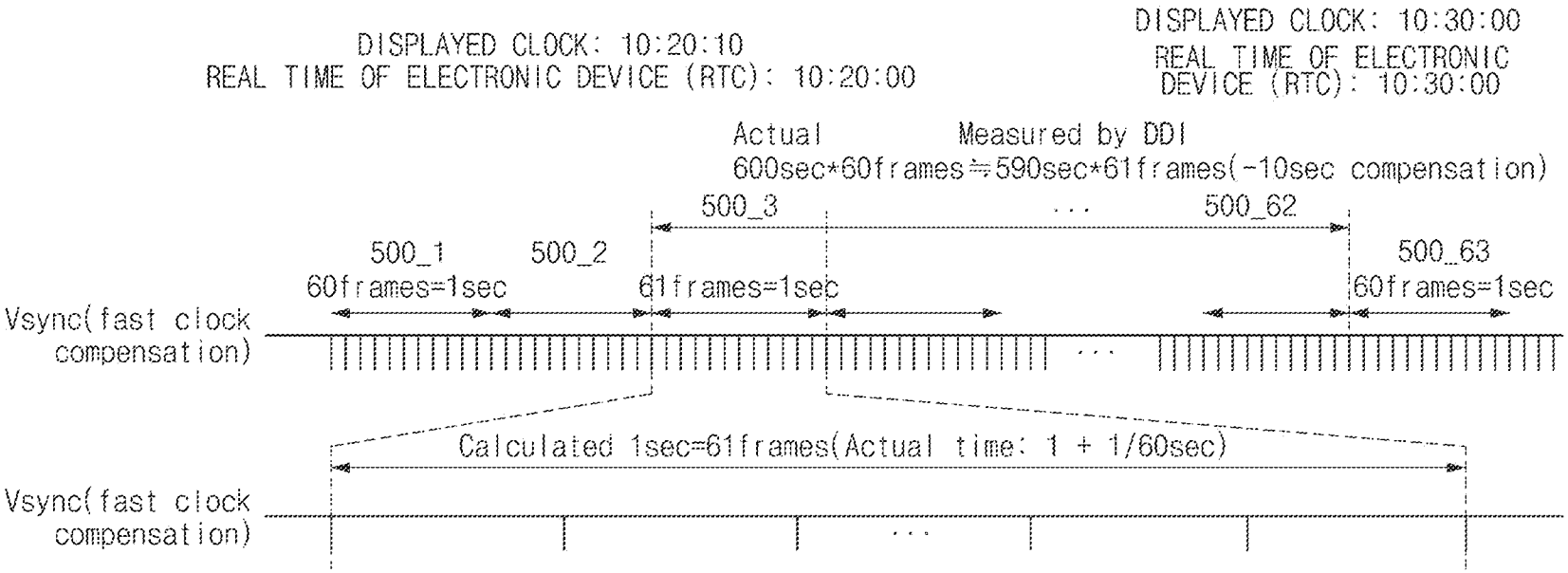
FIG. 5 is a diagram illustrating an example of time compensation, according to an example embodiment of the present disclosure.

FIG. 5 is a diagram illustrating an example of describing time compensation, according to an example embodiment of the present disclosure.

Referring to FIG. 5, at a point in time when the display 160 is initially driven, the display driver integrated circuit 400 may generate a display time based on external reference time information of the processor 300 and may display the generated display time in the display 160. Alternatively, the display driver integrated circuit 400 may display internal time information in the display 160 by using an internal clock generated in the internal clock generator 493, based on the external reference time information that the processor 300 provides. With the above description, the external reference time information that the processor 300 provides and time information generated by the display driver integrated circuit 400 may have the same value.

Meanwhile, the electronic device 100 may perform a time information display function based on an AOD function. In this operation, since the processor 300 of the electronic device 100 enters a sleep state, the processor 300 may fail to provide the external reference time information during a specified time. During the specified time, the display driver integrated circuit 400 may generate the internal time information based on the internal clock and may output the internal time information to the display 160. Here, an error may occur in the internal clock of the display driver integrated circuit 400 due to a temperature, a voltage, and the like of a peripheral environment, and thus, a wrong clock may be provided in a process of displaying a time. In this case, the display driver integrated circuit 400 may generate time information different from the external reference time information of the processor 300.

After the display 160 is initially driven at 10:10:00, the display 160 may display the internal time information based on the internal clock during periods 500_1 and 500_2 from a previous period of the period 500_1. Afterwards, the display driver integrated circuit 400 may receive the external reference time information from the processor 300 in a period 500_3. The external reference time information may be received according to a period that is set in the processor 300. Alternatively, the processor 300 may provide the external reference time information to the display driver integrated circuit 400 when a specified event (e.g., an event that the processor 300 temporarily transitions from a sleep state to a wake-up state, an event that a notification is generated, an event that a message is received, an event that specified sensor information is collected, or the like) occurs. As the external reference time information is received, it may be verified that a time displayed in the display 160 by the display driver integrated circuit 400 is different from an actual time RTC of the electronic device 100 or an external reference time of the processor 300. As illustrated in FIG. 5, the displayed internal time information is "10:20:10", and a real time (or a time according to external time information) is "10:20:00".

In the case where a time error is +10 seconds (or in the case where the internal time information is faster than the actual time by 10 seconds), the display driver integrated circuit 400 may compensate for a Vsync clock. According to a compensation way illustrated in FIG. 5, the display driver integrated circuit 400 may gradually decrease an exceeded error by processing a 61-frame sync signal in units of a specified time (e.g., 1 second). To compensate for 10 seconds, the display driver integrated circuit 400 may perform compensation by adding 1/60s per second. With the above description, the display driver integrated circuit 400 may process a 61-frame sync signal until a period 500_62 in units of a specified time (e.g., 1 second), thus making the actual time of the electronic device 100 and an internal time according to the internal clock of the display driver integrated circuit 400 coincide with each other when the internal time information indicates "10:30:00". Afterwards, from a period 500_63, the display driver integrated circuit 400 may process a 60-frame sync signal in units of a specified time (e.g., 1 second). As described above, the display driver integrated circuit 400 may compensate for an error by changing a reference of a frame number (or the number of frames) that is used to calculate a specified time unit (e.g., 1 second) in a timer (or an oscillator or an internal clock generator) of the display driver integrated circuit 400. For example, in the case where the internal clock is faster than the external reference time information, the display driver integrated circuit 400 may output time information (e.g., a clock image) of 61 frames per second, based on display timing (e.g., 60 Hz). Also, the display driver integrated circuit 400 may gradually change 10-second compensation for 10 minutes to allow the user to fail to perceive error correction.

Figure 6:
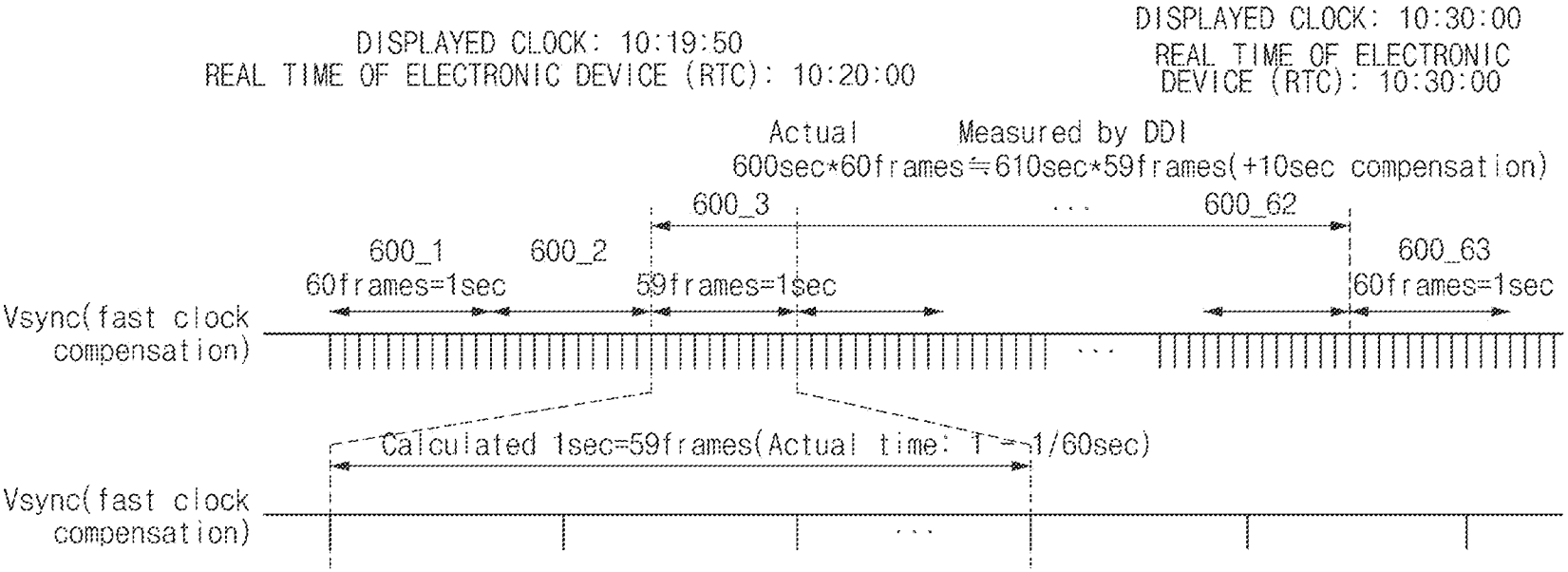
FIG. 6 is a diagram illustrating another example of time compensation, according to an example embodiment of the present disclosure.

FIG. 6 is a diagram illustrating another example describing time compensation, according to an example embodiment of the present disclosure.

Referring to FIG. 6, at a point in time when the display 160 is initially driven, internal time information displayed according to an internal clock of the display driver integrated circuit 400 is "10:10:00", and an actual time (or an external reference time that the processor 300 provides) of the electronic device 100 is also "10:10:00".

The display driver integrated circuit 400 may display internal time information in the display 160 based on the internal clock until the external reference time information is received from the processor 300 (e.g., until periods 600_1 and 600_2 from a previous period of the period 600_1). During the periods, internal time information that the internal clock generator 493 of the display driver integrated circuit 400 generates may include an error due to a temperature or a voltage.

If the external reference time information is received from the processor 300 in a period 600_3, the display driver integrated circuit 400 may compare the external reference time information and the internal time information based on the internal clock. For example, when an internal time is displayed in the display 160 by the display driver integrated circuit 400 is "10:19:50" and an actual time is "10:20:00", an error of −10 seconds may occur.

In this case, the display driver integrated circuit 400 may compensate for a Vsync clock. According to a compensation way illustrated in FIG. 6, the display driver integrated circuit 400 may gradually decrease an exceeded error by processing a 59-frame sync signal in units of a specified time (e.g., 1 second, 1.5 seconds, 2 seconds, or the like; below, 1 second is exemplified). To compensate for −10 seconds, the display driver integrated circuit 400 may perform compensation by subtracting −1/60s per second. With the above description, the display driver integrated circuit 400 may process a 59-frame sync signal from a period 600_3 to a period 600_62 in units of 1 second, thus making the actual time of the electronic device 100 and an internal time according to the internal clock of the display driver integrated circuit 400 coincide with each other when the internal time information of the electronic device 100 indicates "10:30:00". Afterwards, from a period 600_63, the display driver integrated circuit 400 may process a 60-frame sync signal in units of 1 second. As described above, the display driver integrated circuit 400 may gradually change −10-second compensation for 10 minutes to allow the user to fail to perceive error correction. The above-described display driver integrated circuit 400 may change a reference of a frame number used to calculate 1 second in a timer of the display driver integrated circuit 400; if the internal time according to the internal clock of the display driver integrated circuit 400 is later than the external reference time of the processor 300, the display driver integrated circuit 400 may drive a clock image of 59 frames per second based on the display timing (e.g., 60 Hz).

Embodiments are above described as a 61-frame sync signal is processed in units of 1 second to compensate for a time that is faster than the external reference time or as a 59-frame sync signal is processed in units of 1 second to compensate for a time that is later than the external reference time. However, embodiments of the present disclosure may not be limited thereto. For example, to compensate for a fast time, the display driver integrated circuit 400 may process a 62-frame sync signal, a 63-frame sync signal, or the like, in which the number of frames per second is more than that of a 61-frame sync signal, in units of 1 second. For example, to compensate for a late time, the display driver integrated circuit 400 may process a 58-frame sync signal, a 57-frame sync signal, or the like, in which the number of frames per second is less than that of a 59-frame sync signal, in units of 1 second.

According to various example embodiments of the present disclosure, as internal clock-based time information independent of external reference time information is operated, it may be possible to reduce power consumed to drive a processor and to exactly display a time through time compensation.

According to various example embodiments, a time displaying method of an electronic device may include receiving, at a display driver integrated circuit, external reference time information from a device element disposed within the electronic device, comparing internal time information generated by an internal clock of the display driver integrated circuit with the external reference time information and compensating for (adjusting) the internal time information to correspond to the external reference time information if a time error between the internal time information and the external reference time information occurs.

According to various example embodiments, the compensating may include correcting the number of frame sync signals associated with an output of display data to compensate for the time error.

According to various example embodiments, the compensating for the time error may include compensating for a fast time error by increasing the number of frame sync signals processed in units of a specified time if the internal time information is faster than the external reference time information.

According to various example embodiments, the compensating for the time error may include in the case where an image is output at a frame period of "X" Hz (X being a natural number), dividing a magnitude of the fast time error by "1/X" seconds and processing frame sync signals, which are obtained by adding a frame synchronization signal corresponding to "1/X" to frame sync signals for each vertical synchronization or frame sync signals for each line synchronization, in units of a specified time (e.g., 1 second).

According to various example embodiments, the compensating for the time error may include, in the case where an image is output at a frame period of "X" Hz (X being a natural number), processing frame synchronization signals, the number of which is "X+n" (n being a natural number less than "X"), in units of a specified time.

According to various example embodiments, the compensating for the time error may include compensating for a late time error by decreasing the number of frame sync signals processed in units of a specified time if the internal time information is later (slower) than the external reference time information.

According to various example embodiments, the compensating for the time error may include, in the case where an image is output at a frame period of "X" Hz (X being a natural number), dividing a magnitude of the late time error by "1/X" seconds and processing frame sync signals, which are obtained by subtracting a frame synchronization signal corresponding to "1/X" from frame sync signals for each vertical synchronization or frame sync signals for each line synchronization, in units of a specified time.

According to various example embodiments, the compensating for the time error may include, in the case where an image is output at a frame period of "X" Hz (X being a natural number), processing frame synchronization signals, the number of which is "X−n" (n being a natural number less than "X") in units of a specified time.

According to various example embodiments, the compensating may include correcting an offset of an internal clock generator generating the internal clock by a degree corresponding to the time error.

According to various example embodiments, the method may further include at least one of generating the internal time information corresponding to the external reference time information received upon initially driving a display, generating the internal time information based on the internal clock when a processor is in a sleep state and compensating for the time error, generating the internal time information and compensating for the time error, while an always on display (AOD) function of the electronic device is executed and generating a clock image corresponding to the internal time information, the time error of which is corrected, and outputting the clock image on the display.

Figure 7:
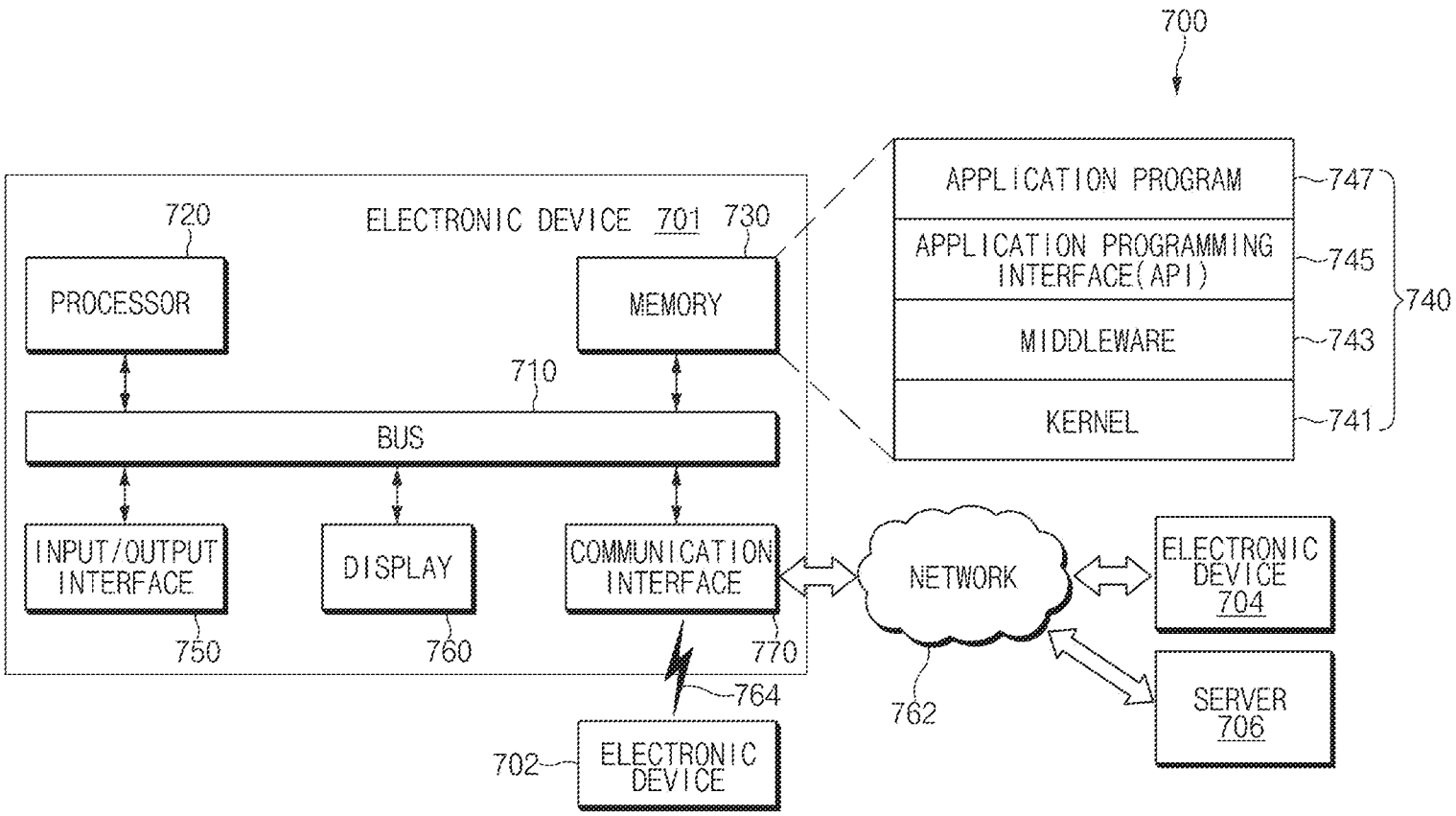
FIG. 7 is a block diagram illustrating an example configuration of an electronic device in a network environment according to an example embodiment.

FIG. 7 is a block diagram illustrating an example configuration of an electronic device in a network environment according to an example embodiment.

Referring to FIG. 7, in various embodiments, an example network environment 700 may include, without limitation, an electronic device 701 and a first external electronic device 702, a second external electronic device 704, or a server 706 may connect with each other through a network 762 or local-area communication 764. The electronic device 701 may include a bus 710, a processor (e.g., including processing circuitry) 720, a memory 730, an input/output interface (e.g., including input/output circuitry) 750, a display 760, and a communication interface 770. In various embodiments, at least one of the components may be omitted from the electronic device 701, or other components may be additionally included in the electronic device 701.

The bus 710 may be, for example, a circuit which connects the components 720 to 770 with each other and transmits a communication signal (e.g., a control message and/or data) between the components.

The processor 720 may include various processing circuitry, such as, for example, and without limitation, one or more of a dedicated processor, a central processing unit (CPU), an application processor (AP), or a communication processor (CP). For example, the processor 720 may perform calculation or data processing about control and/or communication of at least another of the components of the electronic device 701.

The memory 730 may include a volatile and/or non-volatile memory. The memory 730 may store, for example, a command or data associated with at least another of the components of the electronic device 701. According to an embodiment, the memory 730 may store software and/or a program 740. The program 740 may include, for example, a kernel 741, a middleware 743, an application programming interface (API) 745, and/or an least one application program 747 (or "at least one application"), and the like. At least part of the kernel 741, the middleware 743, or the API 745 may be referred to as an operating system (OS).

The kernel 741 may control or manage, for example, system resources (e.g., the bus 710, the processor 720, or the memory 730, and the like) used to execute an operation or function implemented in the other programs (e.g., the middleware 743, the API 745, or the application program 747). Also, as the middleware 743, the API 745, or the application program 747 accesses a separate component of the electronic device 701, the kernel 741 may provide an interface which may control or manage system resources.

The middleware 743 may play a role as, for example, a go-between such that the API 745 or the application program 747 communicates with the kernel 741 to communicate data.

Also, the middleware 743 may process one or more work requests, received from the application program 747, in order of priority. For example, the middleware 743 may assign priority which may use system resources (the bus 710, the processor 720, or the memory 730, and the like) of the electronic device 701 to at least one of the at least one application program 747. For example, the middleware 743 may perform scheduling or load balancing for the one or more work requests by processing the one or more work requests in order of the priority assigned to the at least one of the at least one application program 747.

The API 745 may be, for example, an interface in which the application program 747 controls a function provided from the kernel 741 or the middleware 743. For example, the API 745 may include at least one interface or function (e.g., a command) for file control, window control, image processing, or text control, and the like.

The input/output interface 750 may include various input/output circuitry and play a role as, for example, an interface which may transmit a command or data input from a user or another external device to another component (or other components) of the electronic device 701. Also, input and output interface 750 may output an instruction or data received from another component (or other components) of the electronic device 701 to the user or the other external device.

The display 760 may include, for example, a liquid crystal display (LCD), a light emitting diode (LED) display, an organic LED (OLED) display, a microelectromechanical systems (MEMS) display, or an electronic paper display, or the like, but is not limited thereto. The display 760 may display, for example, a variety of content (e.g., text, images, videos, icons, or symbols, and the like) to the user. The display 760 may include a touch screen, and may receive, for example, touch, gesture, proximity, or a hovering input using an electronic pen or part of a body of the user.

The communication interface 770 may include various communication circuitry and establish communication between, for example, the electronic device 701 and an external device (e.g., a first external electronic device 702, a second external electronic device 704, or a server 706). For example, the communication interface 770 may connect to a network 762 through wireless communication or wired communication and may communicate with the external device (e.g., the second external electronic device 704 or the server 706). Additionally, the communication interface 770 may, for example, establish a short-range or local-area wireless communication connection 764 with an external electronic device (e.g. first external electronic device 702).

The wireless communication may use, for example, at least one of long term evolution (LTE), LTE-advanced (LTE-A), code division multiple access (CDMA), wideband CDMA (WCDMA), universal mobile telecommunications system (UMTS), wireless broadband (WiBro), or global system for mobile communications (GSM), and the like as a cellular communication protocol. Also, the wireless communication may include, for example, local-area communication 764. The local-area communication 764 may include, for example, at least one of wireless-fidelity (Wi-Fi) communication, Bluetooth (BT) communication, near field communication (NFC), or global navigation satellite system (GNSS) communication, and the like.

An MST module may generate a pulse based on transmission data using an electromagnetic signal and may generate a magnetic field signal based on the pulse. The electronic device 701 may output the magnetic field signal to a point of sales (POS) system. The POS system may restore the data by detecting the magnetic field signal using an MST reader and converting the detected magnetic field signal into an electric signal.

The GNSS may include, for example, at least one of a global positioning system (GPS), a Glonass, a Beidou navigation satellite system (hereinafter referred to as "Beidou"), or a Galileo (i.e., the European global satellite-based navigation system) according to an available area or a bandwidth, and the like. Hereinafter, the "GPS" used herein may be interchangeably with the "GNSS". The wired communication may include at least one of, for example, universal serial bus (USB) communication, high definition multimedia interface (HDMI) communication, recommended standard 232 (RS-232) communication, or plain old telephone service (POTS) communication, and the like. The network 762 may include a telecommunications network, for example, at least one of a computer network (e.g., a local area network (LAN) or a wide area network (WAN)), the Internet, or a telephone network.

Each of the first and second external electronic devices 702 and 704 may be the same as or different device from the electronic device 701. According to an embodiment, the server 706 may include a group of one or more servers. According to various embodiments, all or some of operations executed in the electronic device 701 may be executed in another electronic device or a plurality of electronic devices (e.g., the first external electronic device 702, the second external electronic device 704, or the server 706). According to an embodiment, if the electronic device 701 should perform any function or service automatically or according to a request, it may request another device (e.g., the first external electronic device 702, the second external electronic device 704, or the server 106) to perform at least part of the function or service, rather than executing the function or service for itself or in addition to the function or service. The other electronic device (e.g., the first external electronic device 702, the second external electronic device 704, or the server 706) may execute the requested function or the added function and may transmit the executed result to the electronic device 701. The electronic device 701 may process the received result without change or additionally and may provide the requested function or service. For this purpose, for example, cloud computing technologies, distributed computing technologies, or client-server computing technologies may be used.

Figure 8:
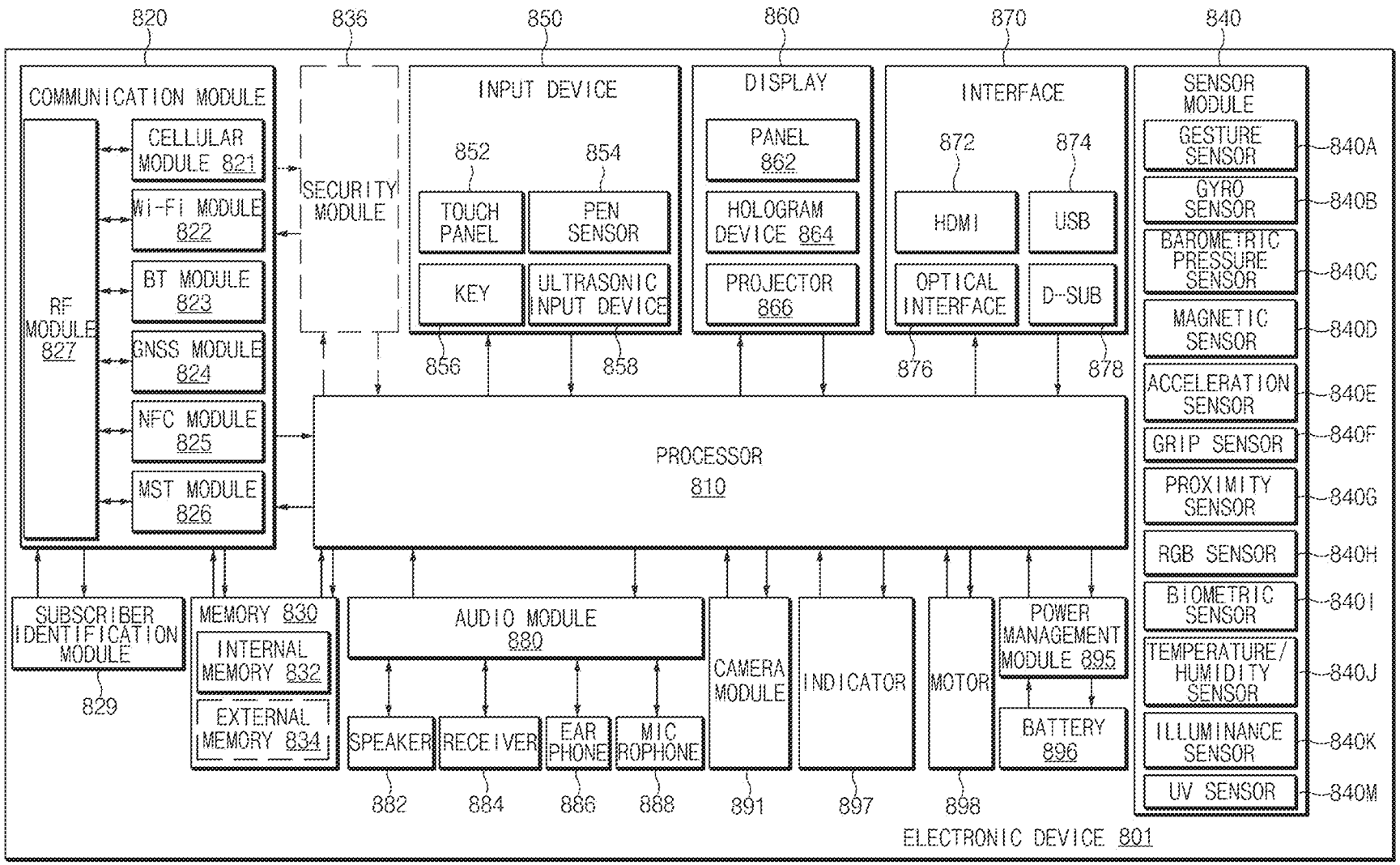
FIG. 8 is a block diagram illustrating an example configuration of an electronic device according to various example embodiments.

FIG. 8 is a block diagram illustrating an example configuration of an electronic device according to various example embodiments.

Referring to FIG. 8, the electronic device 801 may include, for example, all or part of an electronic device 701 illustrated in FIG. 7. The electronic device 801 may include one or more processors (e.g., including processing circuitry) 810 (e.g., application processors (APs)), a communication module (e.g., including communication circuitry) 820, a subscriber identification module (SIM) 829, a memory 830, a security module 836, a sensor module 840, an input device (e.g., including input circuitry) 850, a display 860, an interface (e.g., including interface circuitry) 870, an audio module 880, a camera module 891, a power management module 895, a battery 896, an indicator 897, and a motor 898.

The processor 810 may include various processing circuitry and drive, for example, an operating system (OS) or an application program to control a plurality of hardware or software components connected thereto and may process and compute a variety of data. The processor 810 may be implemented with, for example, a system on chip (SoC). According to an embodiment, the processor 810 may include a graphic processing unit (GPU) (not shown) and/or an image signal processor (not shown). The processor 810 may include at least some (e.g., a cellular module 821) of the components shown in FIG. 8. The processor 810 may load a command or data received from at least one of other components (e.g., a non-volatile memory) into a volatile memory to process the data and may store various data in a non-volatile memory.

The communication module 820 may have the same or similar configuration to a communication interface 1370 of FIG. 7. The communication module 820 may include various communication circuitry, such as, for example, and without limitation, the cellular module 821, a wireless-fidelity (Wi-Fi) module 822, a Bluetooth (BT) module 823, a global navigation satellite system (GNSS) module 824 (e.g., a GPS module, a Glonass module, a Beidou module, or a Galileo module), a near field communication (NFC) module 825, an MST module 826, and a radio frequency (RF) module 827.

The cellular module 821 may provide, for example, a voice call service, a video call service, a text message service, or an Internet service, and the like through a communication network. According to an embodiment, the cellular module 821 may identify and authenticate the electronic device 801 in a communication network using the SIM 829 (e.g., a SIM card). According to an embodiment, the cellular module 821 may perform at least part of functions which may be provided by the processor 810. According to an embodiment, the cellular module 821 may include a communication processor (CP).

The Wi-Fi module 822, the BT module 823, the GNSS module 824, the NFC module 825, or the MST module 826 may include, for example, a processor for processing data transmitted and received through the corresponding module. According to various embodiments, at least some (e.g., two or more) of the cellular module 821, the Wi-Fi module 822, the BT module 823, the GNSS module 824, the NFC module 825, or the MST module 826 may be included in one integrated chip (IC) or one IC package.

The RF module 827 may transmit and receive, for example, a communication signal (e.g., an RF signal). Though not shown, the RF module 827 may include, for example, a transceiver, a power amplifier module (PAM), a frequency filter, or a low noise amplifier (LNA), or an antenna, and the like. According to another embodiment, at least one of the cellular module 821, the Wi-Fi module 822, the BT module 823, the GNSS module 824, the NFC module 825, or the MST module 826 may transmit and receive an RF signal through a separate RF module.

The SIM 829 may include, for example, a card which includes a SIM and/or an embedded SIM. The SIM 829 may include unique identification information (e.g., an integrated circuit card identifier (ICCID)) or subscriber information (e.g., an international mobile subscriber identity (IMSI)).

The memory 830 (e.g., a memory 730 of FIG. 7) may include, for example, an embedded memory 832 and/or an external memory 834. The embedded memory 832 may include at least one of, for example, a volatile memory (e.g., a dynamic random access memory (DRAM), a static RAM (SRAM), a synchronous dynamic RAM (SDRAM), and the like), or a non-volatile memory (e.g., a one-time programmable read only memory (OTPROM), a programmable ROM (PROM), an erasable and programmable ROM (EPROM), an electrically erasable and programmable ROM (EEPROM), a mask ROM, a flash ROM, a flash memory (e.g., a NAND flash memory or a NOR flash memory, and the like), a hard drive, or a solid state drive (SSD)).

The external memory 834 may include a flash drive, for example, a compact flash (CF), a secure digital (SD), a micro-SD, a mini-SD, an extreme digital (xD), a multimedia car (MMC), or a memory stick, and the like. The external memory 834 may operatively and/or physically connect with the electronic device 801 through various interfaces.

The security module 836 may be a module which has a relatively higher secure level than the memory 830 and may be a circuit which stores secure data and guarantees a protected execution environment. The security module 836 may be implemented with a separate circuit and may include a separate processor. The security module 836 may include, for example, an embedded secure element (eSE) which is present in a removable smart chip or a removable SD card or is embedded in a fixed chip of the electronic device 801. Also, the security module 836 may be driven by an OS different from the OS of the electronic device 801. For example, the security module 836 may operate based on a java card open platform (JCOP) OS.

The sensor module 840 may measure, for example, a physical quantity or may detect an operation state of the electronic device 801, and may convert the measured or detected information to an electrical signal. The sensor module 840 may include at least one of, for example, a gesture sensor 840A, a gyro sensor 840B, a barometer (barometric pressure) sensor 840C, a magnetic sensor 840D, an acceleration sensor 840E, a grip sensor 840F, a proximity sensor 840G, a color sensor 840H (e.g., red, green, blue (RGB) sensor), a biometric sensor 840I, a temperature/humidity sensor 840J, an illumination (or illuminance) sensor 840K, or an ultraviolet (UV) sensor 840M. Additionally or alternatively, the sensor module 840 may further include, for example, an e-nose sensor (not shown), an electromyography (EMG) sensor (not shown), an electroencephalogram (EEG) sensor (not shown), an electrocardiogram (ECG) sensor (not shown), an infrared (IR) sensor (not shown), an iris sensor (not shown), and/or a fingerprint sensor (not shown), and the like. The sensor module 840 may further include a control circuit for controlling at least one or more sensors included therein. According to various embodiments, the electronic device 801 may further include a processor configured to control the sensor module 840, as part of the processor 810 or to be independent of the processor 810. While the processor 810 is in a sleep state, the electronic device 801 may control the sensor module 840.

The input device 850 may include various input circuitry, such as, for example, and without limitation, a touch panel 852, a (digital) pen sensor 854, a key 856, or an ultrasonic input device 858. The touch panel 852 may use at least one of, for example, a capacitive type, a resistive type, an infrared type, or an ultrasonic type. Also, the touch panel 852 may further include a control circuit. The touch panel 852 may further include a tactile layer and may provide a tactile reaction to a user.

The (digital) pen sensor 854 may be, for example, part of the touch panel 852 or may include a separate sheet for recognition. The key 856 may include, for example, a physical button, an optical key, or a keypad. The ultrasonic input device 858 may allow the electronic device 801 to detect a sound wave using a microphone (e.g., a microphone 888) and to verify data through an input tool generating an ultrasonic signal.

The display 860 (e.g., a display 760 of FIG. 7) may include a panel 862, a hologram device 864, or a projector 866. The panel 862 may include the same or similar configuration to the display 160 or 760. The panel 862 may be implemented to be, for example, flexible, transparent, or wearable. The panel 862 and the touch panel 852 may be integrated into one module. The hologram device 864 may show a stereoscopic image in a space using interference of light. The projector 866 may project light onto a screen to display an image. The screen may be positioned, for example, inside or outside the electronic device 801. According to an embodiment, the display 860 may further include a control circuit for controlling the panel 862, the hologram device 864, or the projector 866.

The interface 870 may include various interface circuitry, such as, for example, and without limitation, a high-definition multimedia interface (HDMI) 872, a universal serial bus (USB) 874, an optical interface 876, or a D-subminiature 878. The interface 870 may be included in, for example, a communication interface 770 illustrated in FIG. 7. Additionally or alternatively, the interface 870 may include, for example, a mobile high definition link (MHL) interface, an SD card/multimedia card (MMC) interface, or an infrared data association (IrDA) standard interface.

The audio module 880 may convert a sound and an electric signal in dual directions. At least part of components of the audio module 880 may be included in, for example, an input and output interface 750 (or a user interface) shown in FIG. 7. The audio module 880 may process sound information input or output through, for example, a speaker 882, a receiver 884, an earphone 886, or the microphone 888, and the like.

The camera module 891 may be a device which captures a still image and a moving image. According to an embodiment, the camera module 891 may include one or more image sensors (not shown) (e.g., a front sensor or a rear sensor), a lens (not shown), an image signal processor (ISP) (not shown), or a flash (not shown) (e.g., an LED or a xenon lamp).

The power management module 895 may manage, for example, power of the electronic device 801. According to an embodiment, though not shown, the power management module 895 may include a power management integrated circuit (PMIC), a charger IC or a battery or fuel gauge. The PMIC may have a wired charging method and/or a wireless charging method. The wireless charging method may include, for example, a magnetic resonance method, a magnetic induction method, or an electromagnetic method, and the like. An additional circuit for wireless charging, for example, a coil loop, a resonance circuit, or a rectifier, and the like may be further provided. The battery gauge may measure, for example, the remaining capacity of the battery 896 and voltage, current, or temperature thereof while the battery 896 is charged. The battery 896 may include, for example, a rechargeable battery or a solar battery.

The indicator 897 may display a specific state of the electronic device 801 or part (e.g., the processor 810) thereof, for example, a booting state, a message state, or a charging state, and the like. The motor 898 may convert an electric signal into mechanical vibration and may generate vibration or a haptic effect, and the like. Though not shown, the electronic device 801 may include a processing unit (e.g., a GPU) for supporting a mobile TV. The processing unit for supporting the mobile TV may process media data according to standards, for example, a digital multimedia broadcasting (DMB) standard, a digital video broadcasting (DVB) standard, or a mediaFlo™ standard, and the like.

Each of the above-mentioned elements of the electronic device according to various embodiments of the present disclosure may be configured with one or more components, and names of the corresponding elements may be changed according to the type of the electronic device. The electronic device according to various embodiments of the present disclosure may include at least one of the above-mentioned elements, some elements may be omitted from the electronic device, or other additional elements may be further included in the electronic device. Also, some of the elements of the electronic device according to various embodiments of the present disclosure may be combined with each other to form one entity, thereby making it possible to perform the functions of the corresponding elements in the same manner as before the combination.

Figure 9:
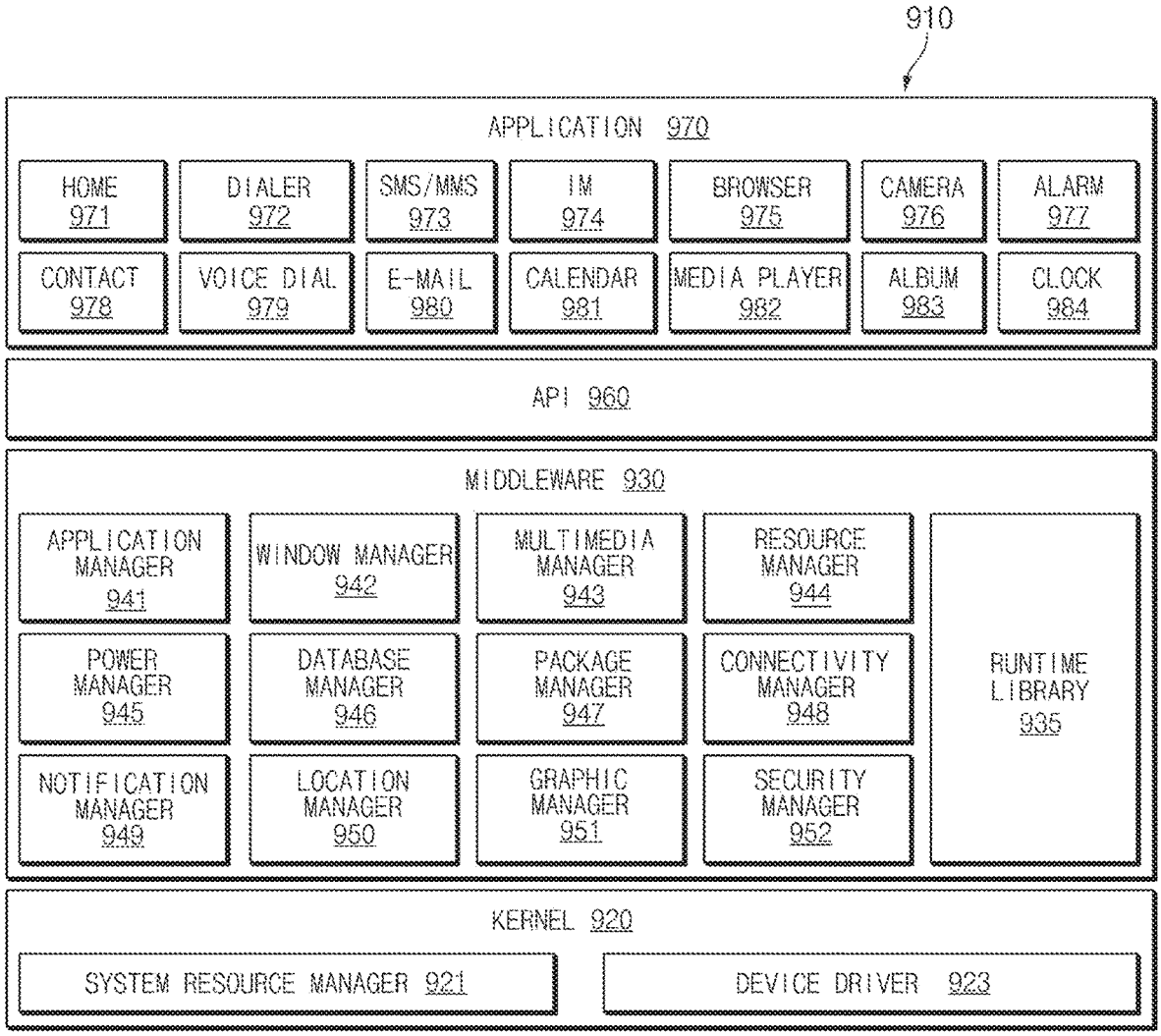
FIG. 9 is a block diagram illustrating an example configuration of a program module according to various example embodiments.

FIG. 9 is a block diagram illustrating an example configuration of a program module according to various example embodiments.

According to an embodiment, the program module 910 (e.g., a program 740 of FIG. 7) may include an operating system (OS) for controlling resources associated with an electronic device (e.g., an electronic device 701 of FIG. 7) and/or various applications (e.g., an application program 747 of FIG. 7) which are executed on the OS. The OS may be, for example, Android, iOS, Windows, Symbian, Tizen, or Bada, and the like.

The program module 910 may include a kernel 920, a middleware 930, an application programming interface (API) 960, and/or an application 970. At least part of the program module 910 may be preloaded on the electronic device, or may be downloaded from an external electronic device (e.g., a first external electronic device 702, a second external electronic device 704, or a server 706, and the like of FIG. 7).

The kernel 920 (e.g., a kernel 741 of FIG. 7) may include, for example, a system resource manager 921 and/or a device driver 923. The system resource manager 921 may control, assign, or collect, and the like system resources. According to an embodiment, the system resource manager 921 may include a process management unit, a memory management unit, or a file system management unit, and the like. The device driver 923 may include, for example, a display driver, a camera driver, a Bluetooth (BT) driver, a shared memory driver, a universal serial bus (USB) driver, a keypad driver, a wireless-fidelity (Wi-Fi) driver, an audio driver, or an inter-process communication (IPC) driver.

The middleware 930 (e.g., a middleware 743 of FIG. 7) may provide, for example, functions the application 970 needs in common, and may provide various functions to the application 970 through the API 960 such that the application 970 efficiently uses limited system resources in the electronic device. According to an embodiment, the middleware 930 (e.g., the middleware 743) may include at least one of a runtime library 935, an application manager 941, a window manager 942, a multimedia manager 943, a resource manager 944, a power manager 945, a database manager 946, a package manager 947, a connectivity manager 948, a notification manager 949, a location manager 950, a graphic manager 951, a security manager 952, or a payment manager (not shown).

The runtime library 935 may include, for example, a library module used by a compiler to add a new function through a programming language while the application 970 is executed. The runtime library 935 may perform a function about input and output management, memory management, or an arithmetic function.

The application manager 941 may manage, for example, a life cycle of at least one of the application 970. The window manager 942 may manage graphic user interface (GUI) resources used on a screen of the electronic device. The multimedia manager 943 may determine a format utilized for reproducing various media files and may encode or decode a media file using a codec corresponding to the corresponding format. The resource manager 944 may manage source codes of at least one of the application 970, and may manage resources of a memory or a storage space, and the like.

The power manager 945 may act together with, for example, a basic input/output system (BIOS) and the like, may manage a battery or a power source, and may provide power information utilized for an operation of the electronic device. The database manager 946 may generate, search, or change a database to be used in at least one of the application 970. The package manager 947 may manage installation or update of an application distributed by a type of a package file.

The connectivity manager 948 may manage, for example, wireless connection such as Wi-Fi connection or BT connection, and the like. The notification manager 949 may display or notify events, such as an arrival message, an appointment, and proximity notification, by a method which is not disturbed to the user. The location manager 950 may manage location information of the electronic device. The graphic manager 951 may manage a graphic effect to be provided to the user or a user interface (UI) related to the graphic effect. The security manager 952 may provide all security functions utilized for system security or user authentication, and the like. According to an embodiment, when the electronic device (e.g., an electronic device 100 or 701 of FIG. 1 or 7) has a phone function, the middleware 930 may further include a telephony manager (not shown) for managing a voice or video communication function of the electronic device.

The middleware 930 may include a middleware module which configures combinations of various functions of the above-described components. The middleware 930 may provide a module which specializes according to kinds of OSs to provide a differentiated function. Also, the middleware 930 may dynamically delete some of old components or may add new components.

The API 960 (e.g., an API 745 of FIG. 7) may be, for example, a set of API programming functions, and may be provided with different components according to OSs. For example, in case of Android or iOS, one API set may be provided according to platforms. In case of Tizen, two or more API sets may be provided according to platforms.

The application 970 (e.g., an application program 747 of FIG. 7) may include one or more of, for example, a home application 971, a dialer application 972, a short message service/multimedia message service (SMS/MMS) application 973, an instant message (IM) application 974, a browser application 975, a camera application 976, an alarm application 977, a contact application 978, a voice dial application 979, an e-mail application 980, a calendar application 981, a media player application 982, an album application 983, a clock application 984. Additionally or alternatively, though not shown, the application 970 may include, for example, a health care application (e.g., an application for measuring quantity of exercise or blood sugar, and the like), or an environment information application (e.g., an application for providing atmospheric pressure information, humidity information, or temperature information, and the like), and the like.

According to an embodiment, the application 970 may include an application (hereinafter, for better understanding and ease of description, referred to as "information exchange application") for exchanging information between the electronic device (e.g., the electronic device 701 of FIG. 7) and an external electronic device (e.g., the first external electronic device 702 or the second external electronic device 704). The information exchange application may include, for example, a notification relay application for transmitting specific information to the external electronic device or a device management application for managing the external electronic device.

For example, the notification relay application may include a function of transmitting notification information, which is generated by other applications (e.g., the SMS/MMS application, the e-mail application, the health care application, or the environment information application, and the like) of the electronic device, to the external electronic device (e.g., the first external electronic device 702 or the second external electronic device 704). Also, the notification relay application may receive, for example, notification information from the external electronic device, and may provide the received notification information to the user of the electronic device.

The device management application may manage (e.g., install, delete, or update), for example, at least one (e.g., a function of turning on/off the external electronic device itself (or partial components) or a function of adjusting brightness (or resolution) of a display) of functions of the external electronic device (e.g., the first external electronic device 702 or the second external electronic device 704) which communicates with the electronic device, an application which operates in the external electronic device, or a service (e.g., a call service or a message service) provided from the external electronic device.

According to an embodiment, the application 970 may include an application (e.g., the health card application of a mobile medical device) which is preset according to attributes of the external electronic device (e.g., the first external electronic device 702 or the second external electronic device 704). According to an embodiment, the application 970 may include an application received from the external electronic device (e.g., the server 706, the first external electronic device 702, or the second external electronic device 704). According to an embodiment, the application 970 may include a preloaded application or a third party application which may be downloaded from a server. Names of the components of the program module 910 according to various embodiments of the present disclosure may differ according to kinds of OSs.

According to various embodiments, at least part of the program module 910 may be implemented with software, firmware, hardware, or at least two or more combinations thereof. At least part of the program module 910 may be implemented (e.g., executed) by, for example, a processor (e.g., a processor 720 of FIG. 7). At least part of the program module 910 may include, for example, a module, a program, a routine, sets of instructions, or a process, and the like for performing one or more functions.

The terminology "module" used herein may refer, for example, to a unit including one of hardware, software, and firmware or two or more combinations thereof. The terminology "module" may be interchangeably used with, for example, terminologies "unit", "logic", "logical block", "component", or "circuit", and the like. The "module" may be a minimum unit of an integrated component or a part thereof. The "module" may be a minimum unit performing one or more functions or a part thereof. The "module" may be mechanically or electronically implemented. For example, the "module" may include, for example, and without limitation, at least one of a dedicated processor, a CPU, an application-specific integrated circuit (ASIC) chip, field-programmable gate arrays (FPGAs), or a programmable-logic device, which is well known or will be developed in the future, for performing certain operations.

According to various embodiments of the present disclosure, at least part of a device (e.g., modules or the functions) or a method (e.g., operations) may be implemented with, for example, instructions stored in computer-readable storage media which have a program module. When the instructions are executed by a processor, one or more processors may perform functions corresponding to the instructions. The computer-readable storage media may be, for example, a memory.

The computer-readable storage media may include a hard disc, a floppy disk, magnetic media (e.g., a magnetic tape), optical media (e.g., a compact disc read only memory (CD-ROM) and a digital versatile disc (DVD)), magneto-optical media (e.g., a floptical disk), a hardware device (e.g., a ROM, a random access memory (RAM), or a flash memory, and the like), and the like. Also, the program instructions may include not only mechanical codes compiled by a compiler but also high-level language codes which may be executed by a computer using an interpreter and the like. The above-mentioned hardware device may be configured to operate as one or more software modules to perform operations according to various embodiments of the present disclosure, and vice versa.

Modules or program modules according to various embodiments of the present disclosure may include at least one or more of the above-mentioned components, some of the above-mentioned components may be omitted, or other additional components may be further included. Operations executed by modules, program modules, or other components may be executed by a successive method, a parallel method, a repeated method, or a heuristic method. Also, some operations may be executed in a different order or may be omitted, and other operations may be added.

Embodiments of the present disclosure described and illustrated in the drawings are provided as examples to describe technical content and to aid in understanding but do not limit the present disclosure. Accordingly, it should be understood that besides the embodiments listed herein, all modifications or modified forms derived based on the technical ideas of the present disclosure are included in the present disclosure as defined in the claims, and their equivalents.

The above-described embodiments of the present disclosure can be implemented in hardware, firmware or via the execution of software or computer code that can be stored in a recording medium such as a CD ROM, a Digital Versatile Disc (DVD), a magnetic tape, a RAM, a floppy disk, a hard disk, or a magneto-optical disk or computer code downloaded over a network originally stored on a remote recording medium or a non-transitory machine readable medium and to be stored on a local recording medium, so that the methods described herein can be rendered via such software that is stored on the recording medium using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein.

The control unit, controller, processor, and the like described herein may include a microprocessor or any suitable type of processing circuitry, such as one or more general-purpose processors (e.g., ARM-based processors), a Digital Signal Processor (DSP), a Programmable Logic Device (PLD), an Application-Specific Integrated Circuit (ASIC), a Field-Programmable Gate Array (FPGA), a Graphical Processing Unit (GPU), a video card controller, etc. In addition, it would be recognized that when a general purpose computer accesses code for implementing the processing shown herein, the execution of the code transforms the general purpose computer into a special purpose computer for executing the processing shown herein. Any of the functions and steps provided in the Figures may be implemented in hardware, software or a combination of both and may be performed in whole or in part within the programmed instructions of a computer. In addition, an artisan understands and appreciates that a "processor" or "microprocessor" may be hardware in the claimed disclosure.

While the present disclosure has been illustrated and described with reference to various example embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a display;

a display driver integrated circuit for driving the display;

one or more processor configured to:

provide image data to the display driver integrated circuit;

generate time information using a first oscillator in the one or more processor rather than the display driver integrated circuit;

wherein the display driver integrated circuit is configured to:

receive a first time information from the one or more processor when a sleep state of the one or more processor is changed to a wake-up state;

generate current time information based on the received first time information, using a second oscillator in the display driver integrated circuit while the one or more processor is in sleep state;

control the display to display a clock image corresponding to the current time information;

while the clock image is displayed on the display, receive a second time information from the one or more processor, and modify a current time to be displayed based on the second time information by adjusting the number of frame sync signals associated with an output of display data to compensate for a time error between the current time information and the second time information.

2. The electronic device of claim 1, wherein the display driver integrated circuit is further configured to:

identify the time error as between the current time information and the second time information;

modify the current time information based on the time error; and wherein the time error is caused by a clock difference of the first oscillator and the second oscillator.

3. The electronic device of claim 2, wherein the display driver integrated circuit is configured to:

compensate for a fast time error by increasing the number of frame sync signals processed in units of a specified time if the current time information is faster than the second time information.

4. The electronic device of claim 3, wherein the display driver integrated circuit is configured to:

where an image is output at a frame period of X Hz, X being a natural number, divide a magnitude of the fast time error by 1/X seconds and process frame sync signals which are obtained by adding a frame synchronization signal corresponding to 1/X to frame sync signals for each vertical synchronization or frame sync signals for each line synchronization, in units of the specified time.

5. The electronic device of claim 2, wherein the display driver integrated circuit is configured to:

compensate for a late time error by decreasing the number of frame sync signals processed in units of a specified time if the current time information is later than the second time information.

6. The electronic device of claim 5, wherein the display driver integrated circuit is configured to:

where an image is output at a frame period of X Hz, X being a natural number, divide a magnitude of the late time error by 1/X seconds and process frame sync signals, which are obtained by subtracting a frame synchronization signal corresponding to 1/X from frame sync signals for each vertical synchronization or frame sync signals for each line synchronization, in units of the specified time.

7. The electronic device of claim 2, wherein the display driver integrated circuit is configured to:

generate the current time information corresponding to the first time information received upon initially driving the display; or generate the current time information and compensate for the time error, while an always on display (AOD) function of the electronic device is executed.

8. The electronic device of claim 2, wherein the display driver integrated circuit includes:

a memory configured to store display data associated with displaying the time information;

a time compensation circuit configured to determine the time error between the second time information and the current time information and to generate the time information, the time error of which is corrected;

a display timing controller configured to control the display to output the time information, the time error of which is corrected;

an internal clock generator configured to generate a clock of the second oscillator;

a display synchronization generator comprising circuitry configured to generate a display synchronization signal based on the clock and to provide the display synchronization signal on the display; and a clock image generation device comprising circuitry configured to generate the clock image.

9. The electronic device of claim 8, wherein the display driver integrated circuit is configured to:

correct an offset of the clock generator generating the internal clock by a degree corresponding to the time error.

10. The electronic device of claim 8, wherein the time compensation circuit includes:

a time comparison circuit configured to compare the second time information and the current time information generated by the clock;

an error correction circuit configured to generate an error correction signal corresponding to a value of the time error;

a time synchronization generator comprising circuitry configured to generate a time synchronization signal based on the error correction signal received from the error correction circuit and the display synchronization signal provided by the display synchronization generator; and an current time information generator configured to generate the time information based on the time synchronization signal.

11. A time displaying method of an electronic device, the method comprising:

receiving, at a display driver integrated circuit disposed within the electronic device, a first time information from a one or more processor disposed within the electronic device when a sleep state of the one or more processor is changed to a wake-up state and operatively connected with the display driver integrated circuit, the one or more processor comprising a first oscillator;

generating current time information based on the first time information, using a second oscillator in the display driver integrated circuit while the one or more processor is in sleep state;

causing to be displayed, by the display driver integrated circuit, a clock image corresponding to the current time information on a display;

while the clock image is displayed on the display, receiving a second time information; and modifying a current time information to be displayed based on the second time information by adjusting the number of frame sync signals associated with an output of display data to compensate for a time error between the current time information and the second time information.

12. The method of claim 11, wherein the modifying includes:

identifying a time error between the current time information and the second time information;

modifying the current time information based on the time error; and compensating for a fast time error by increasing the number of frame sync signals processed in units of a specified time if the current time information is faster than the external time information, wherein the time error is caused by a clock difference of the first oscillator and the second oscillator.

13. The method of claim 12, wherein the modifying includes:

where an image is output at a frame period of X Hz, X being a natural number, dividing a magnitude of the fast time error by 1/X seconds and processing frame sync signals, which are obtained by adding a frame synchronization signal corresponding to 1/X to frame sync signals for each vertical synchronization or frame sync signals for each line synchronization, in units of the specified time.

14. The method of claim 12, wherein the modifying includes:

where an image is output at a frame period of X Hz, X being a natural number, processing frame synchronization signals, the number of which is X+n, n being a natural number less than X, in units of a specified time.

15. The method of claim 11, wherein the modifying includes:

compensating for a late time error by decreasing the number of frame sync signals processed in units of a specified time if the current time information is later than the second time information.

16. The method of claim 15, wherein the modifying includes:

where an image is output at a frame period of X Hz, X being a natural number, dividing a magnitude of the late time error by 1/X seconds and processing frame sync signals, which are obtained by subtracting a frame synchronization signal corresponding to 1/X from frame sync signals for each vertical synchronization or frame sync signals for each line synchronization, in units of the specified time.

17. The method of claim 15, wherein the modifying includes:

where an image is output at a frame period of X Hz, X being a natural number, processing frame synchronization signals, the number of which is X−n, n being a natural number less than X in units of a specified time.

18. The method of claim 11, wherein the modifying includes:

modifying an offset of an internal clock generator generating a clock of the second oscillator by a degree corresponding to the time error.

19. The method of claim 11, further comprising at least one of:

generating the current time information corresponding to first time information received upon initially driving a display;

generating the current time information and compensating for the time error, while an always on display (AOD) function of the electronic device is executed; and generating a clock image corresponding to the current time information, the time error of which is corrected, and outputting the clock image on the display.

20. The method of claim 11, wherein the receiving the second time information includes receiving the second time information through MIPI (Mobile Industry Processor Interface) command.

* * * * *